US009629455B2

(12) United States Patent
Shah et al.

(10) Patent No.: US 9,629,455 B2
(45) Date of Patent: Apr. 25, 2017

(54) STORAGE APPARATUS

(71) Applicant: NewAge Products, Inc., Vaughan (CA)

(72) Inventors: Parag Shah, Toronto (CA); Frank Spano, Toronto (CA); Robert Vandenham, Toronto (CA)

(73) Assignee: NEWAGE PRODUCTS, INC., Vaughan (CA)

( * ) Notice: Subject to any disclaimer, the term of this patent is extended or adjusted under 35 U.S.C. 154(b) by 12 days.

(21) Appl. No.: 14/698,540

(22) Filed: Apr. 28, 2015

(65) Prior Publication Data

US 2015/0305494 A1 Oct. 29, 2015

Related U.S. Application Data

(60) Provisional application No. 61/984,909, filed on Apr. 28, 2014.

(51) Int. Cl.

| | |
|---|---|
| ***A47F 5/08*** | (2006.01) |
| ***A47B 47/00*** | (2006.01) |
| ***A47B 43/00*** | (2006.01) |
| *A47B 51/00* | (2006.01) |

(52) U.S. Cl.

CPC ..... *A47B 47/0083* (2013.01); *A47B 43/003* (2013.01); *A47F 5/0892* (2013.01); *A47B 2051/005* (2013.01)

(58) Field of Classification Search

CPC ..... A47B 43/003; A47F 5/0892
USPC ..... 211/117
See application file for complete search history.

(56) References Cited

U.S. PATENT DOCUMENTS

| | | | |
|---|---|---|---|
| 478,805 | A | 7/1892 | Munson |
| 557,567 | A | 4/1896 | Eddy |
| 579,584 | A | 3/1897 | Jessup |
| 587,945 | A | 8/1897 | Elliott |
| 588,542 | A | 8/1897 | Williams |
| 590,773 | A | 9/1897 | Pruden |

(Continued)

FOREIGN PATENT DOCUMENTS

| | | | |
|---|---|---|---|
| EP | 0 154 704 | A2 | 9/1985 |
| WO | WO 02/32257 | A1 | 4/2002 |
| WO | WO 2005/074747 | A1 | 8/2005 |

OTHER PUBLICATIONS

Newage Products Inc., Install Instructions for VERSARAC, Apr. 3, 2014, 14 pages (in English and French languages).

(Continued)

*Primary Examiner* — Leslie A Nicholson, III
*Assistant Examiner* — Kimberley S Wright
(74) *Attorney, Agent, or Firm* — Howard & Howard Attorneys PLLC

(57) ABSTRACT

A storage apparatus attachable to a surface includes a polygonal support frame having first, second, third, and fourth support beams, a plurality of cross beams, and a plurality of suspension legs. In one embodiment, the storage apparatus further includes racks supported on at least a portion of the support beams and defining a first series of racks aligned transverse to a longitudinal axis and a second series of racks aligned along the longitudinal axis with the first series of racks being removable during adjustment of the first and second support beams and the second series of racks being removable during adjustment of the third and fourth support beams.

28 Claims, 32 Drawing Sheets

(56) References Cited

U.S. PATENT DOCUMENTS 608,393 A 8/1898 Jackson et al.
610,656 A 9/1898 Martin
611,856 A 10/1898 Brown et al.
624,231 A 5/1899 Martin
653,386 A 7/1900 Hunter
706,718 A 8/1902 Bradbury
2,057,092 A 10/1936 Geib
2,559,322 A 7/1951 Skamser
3,139,045 A 6/1964 Rojakovick
3,188,039 A 6/1965 Krohn
3,190,604 A 6/1965 Jorgensen et al.
3,735,951 A 5/1973 Reed
3,770,133 A 11/1973 Kolker
3,771,466 A 11/1973 Ferdinand et al.
3,782,559 A 1/1974 Wright
3,837,609 A 9/1974 Weiss et al.
3,872,972 A 3/1975 Cummins et al.
3,924,751 A 12/1975 Ballenger
3,945,462 A 3/1976 Griswold
4,116,341 A 9/1978 Hebda
4,142,705 A 3/1979 Miller
4,167,908 A 9/1979 Jones et al.
4,316,544 A 2/1982 Goldstein
4,352,432 A 10/1982 Smith
4,392,572 A 7/1983 Bernard
4,441,583 A 4/1984 Vaught
4,552,270 A 11/1985 Lentz et al.
4,630,423 A 12/1986 Lind
4,650,144 A 3/1987 Conrad
4,700,845 A 10/1987 Fretter
4,813,550 A 3/1989 Saeks
4,830,196 A 5/1989 Csanady
4,840,278 A 6/1989 Gelinas
5,074,419 A 12/1991 Smith
5,078,276 A 1/1992 Rogge et al.
5,082,120 A 1/1992 Vega
5,082,123 A 1/1992 Lamb
5,086,930 A 2/1992 Saeks
D326,579 S 6/1992 Leeds
5,125,517 A 6/1992 Martine
5,240,122 A 8/1993 Arnold
5,246,120 A 9/1993 Walker
5,292,009 A 3/1994 Smith
5,332,104 A 7/1994 Santella
5,351,926 A 10/1994 Moses
5,354,035 A 10/1994 Helgren
5,460,274 A 10/1995 Kramer
5,474,189 A 12/1995 Peterson
5,702,007 A 12/1997 Fritz et al.
5,737,801 A 4/1998 Flood
5,749,479 A 5/1998 Belokin et al.
5,772,048 A 6/1998 Sopcisak
5,794,793 A 8/1998 Frederick
5,848,708 A 12/1998 Edwards
D406,972 S 3/1999 McCoy
D416,152 S 11/1999 Payne et al.
5,984,111 A 11/1999 Pennella
6,015,127 A 1/2000 Carr
6,050,426 A 4/2000 Leurdijk
6,095,344 A 8/2000 White
6,109,461 A 8/2000 Kluge et al.
6,145,678 A 11/2000 Morrison
6,161,702 A 12/2000 Campbell
6,161,709 A 12/2000 Kluge et al.
6,179,136 B1 1/2001 Kluge et al.
6,182,836 B1 2/2001 Gutierrez
6,286,691 B1 9/2001 Oberhaus et al.
6,311,626 B1 11/2001 Roberts
6,332,597 B1 12/2001 Korcz et al.
6,409,031 B1 6/2002 Wynne
D459,926 S 7/2002 Mikich et al.
6,435,105 B1 8/2002 Mikich et al.
D470,353 S 2/2003 Mikich et al.
D477,957 S 8/2003 Mikich et al.
6,715,427 B2 4/2004 Mikich et al.
6,725,608 B1 4/2004 Kraus
6,883,513 B2 4/2005 Bock
7,000,783 B2 2/2006 Webb
D516,348 S 3/2006 Satterthwaite
7,021,476 B2 4/2006 Lloyd et al.
D525,811 S 8/2006 Nawrocki
D526,519 S 8/2006 Nawrocki
7,128,225 B2 10/2006 Saltzburg et al.
7,150,449 B1 12/2006 Dueck et al.
7,150,591 B1 12/2006 Kent
7,152,535 B2 * 12/2006 Mikich ..... A47B 5/00 108/149
7,165,684 B2 1/2007 Ferron
7,225,933 B1 6/2007 Pollock et al.
7,228,669 B1 6/2007 Yaraschefski
7,252,202 B2 8/2007 Saltzberg et al.
7,255,237 B2 * 8/2007 Stitchick ..... A47B 47/022 211/106
D553,401 S 10/2007 Peddycord
7,357,262 B2 * 4/2008 Fratilla ..... A47B 47/02 211/117
7,421,957 B2 9/2008 Baez
7,494,110 B2 2/2009 Lob et al.
7,543,538 B2 6/2009 Baez
D597,354 S 8/2009 Liss
7,604,131 B1 10/2009 Clark et al.
7,669,822 B2 3/2010 Kluge et al.
7,770,419 B2 8/2010 Stone
7,810,438 B2 10/2010 Ryberg
7,815,055 B2 10/2010 Lang
D637,427 S 5/2011 Troyner et al.
7,967,155 B2 6/2011 Klingspor et al.
8,066,131 B2 * 11/2011 Mansor ..... A47B 43/003 211/117
D653,064 S 1/2012 Lutt
8,117,970 B1 2/2012 Baez
8,132,764 B2 3/2012 Kuipers
8,245,651 B1 8/2012 Mikich et al.
8,371,458 B2 2/2013 Yu
8,511,486 B2 * 8/2013 Mansor ..... A47B 43/00 211/117
8,651,294 B2 * 2/2014 Mansor ..... A47B 43/003 108/42
8,794,454 B2 8/2014 Bleazard
8,827,232 B2 * 9/2014 Crowley ..... A47B 43/003 211/175
8,893,899 B1 11/2014 Hund
8,893,900 B2 11/2014 Kedar
9,010,553 B2 * 4/2015 Crowley ..... A47B 43/003 211/189
9,228,756 B2 * 1/2016 Crowley ..... A47B 43/003
D753,420 S 4/2016 Cheng
2002/0023888 A1 2/2002 Wynne et al.
2004/0050807 A1 3/2004 Cheng
2004/0149878 A1 8/2004 Gierke et al.
2004/0182291 A1 * 9/2004 Mikich ..... A47B 5/00 108/149
2004/0226899 A1 11/2004 Ferron
2005/0098511 A1 5/2005 Webb
2006/0180554 A1 8/2006 Lang
2007/0007223 A1 * 1/2007 Thrush ..... A47B 96/14 211/118
2007/0108357 A1 5/2007 Plowman
2007/0119805 A1 * 5/2007 Nawrocki ..... A47B 55/02 211/119
2007/0138357 A1 6/2007 Carroll
2007/0205169 A1 * 9/2007 Fratilla ..... A47B 47/02 211/117
2009/0108160 A1 4/2009 Kluge et al.
2009/0278004 A1 11/2009 Eustace et al.
2011/0062301 A1 * 3/2011 Sloan ..... A47B 43/003 248/304
2011/0182704 A1 * 7/2011 Mansor ..... A47B 43/00 414/266
2011/0198307 A1 * 8/2011 Mansor ..... A47B 43/003 211/117
2012/0103923 A1 * 5/2012 Mansor ..... A47B 43/003 211/118

(56) References Cited

U.S. PATENT DOCUMENTS

| | | | | |
|---|---|---|---|---|
| 2012/0145659 | A1* | 6/2012 | Mansor | A47B 43/00 211/116 |
| 2012/0181240 | A1* | 7/2012 | Crowley | A47B 43/003 211/26 |
| 2013/0228536 | A1* | 9/2013 | Crowley | A47B 43/003 211/26 |
| 2013/0270201 | A1 | 10/2013 | Vineyard | |
| 2013/0327802 | A1 | 12/2013 | Hammond | |
| 2013/0334150 | A1 | 12/2013 | Watson | |
| 2014/0014607 | A1 | 1/2014 | Mikich et al. | |
| 2014/0138334 | A1* | 5/2014 | Mansor | A47B 43/00 211/117 |
| 2014/0151315 | A1* | 6/2014 | Mansor | A47B 43/00 211/117 |
| 2014/0312200 | A1* | 10/2014 | Crowley | A47B 43/003 248/670 |
| 2015/0014886 | A1 | 1/2015 | Mullaney | |
| 2015/0060374 | A1* | 3/2015 | Mansor | A47F 5/0892 211/2 |
| 2015/0226451 | A1* | 8/2015 | Crowley | A47B 43/003 248/676 |

OTHER PUBLICATIONS

Newage Products Inc., sample Packaging for Grey-4'×8' Overhead Rack, SKU: 40148-77748, Box 1 of 2, Apr. 3, 2014, 1 page.
Newage Products Inc., sample Packaging for Grey-4'×8' Overhead Rack, SKU: 40148-77748, Box 2 of 2, Apr. 3, 2014, 1 page.
Newage Products Inc., sample Packaging for Grey-4'×4' Overhead Rack, SKU: 40144-77744, Box 1 of 1, Apr. 3, 2014, 1 page.
Web pages from Internet URL page www.onrax.com, 5 pages.
Web pages from Internet URL page www.storemoreshelving.com, Dec. 6, 2013, 4 pages.
Web pages from Internet URL page www.offthefloor.com, 3 pages.
Web pages from Internet URL page www.hyloftusa.com, 4 pages.
Web pages from Internet URL pages www.theunclutteredgarageh.com/index.html, 5 pages.
Design U.S. Appl. No. 29/522,286, filed Mar. 30, 2015, 34 pages.

* cited by examiner

STORAGE APPARATUS

CROSS REFERENCE TO RELATED APPLICATIONS

The subject application claims priority to and all of the benefits of U.S. Provisional Application Ser. No. 61/984,909, filed Apr. 28, 2014, the contents of which are expressly incorporated herein in their entirety.

FIELD OF THE DISCLOSURE

The present disclosure relates generally to storage apparatuses and, more particularly, to a storage apparatus attachable to a surface.

BACKGROUND

Storage apparatuses are typically used in residential and/or commercial properties for storing items. Some storage apparatuses may be attachable to a surface, such as to a ceiling inside of a building, and one or more items may be placed or stacked on the apparatus when attached to the surface. Also when the apparatus is attached to the surface, such as to the ceiling, one or more items may also be placed or stacked underneath the apparatus. Accordingly, storage apparatuses attachable to a surface may increase the storage capacity or space inside the building.

In some instances, it may be desirable to adjust one or more dimensions of the apparatus to fit the apparatus in a particular location, to increase the storage capacity, and/or the like. While many storage apparatuses offer adjustability, the adjustment of the storage apparatus may be difficult and/or cumbersome for the user.

Accordingly, there is an opportunity to develop an improved storage apparatus which is attachable to a surface, such as a ceiling of a building.

SUMMARY

A storage apparatus attachable to a surface comprises a polygonal support frame having a first support beam defining a longitudinal axis and being adjustable along the longitudinal axis between a first and a second length, a second support beam spaced from the first support beam with the second support beam extending along the longitudinal axis and being adjustable along the longitudinal axis between the first and second lengths, a third support beam extending transverse to the longitudinal axis and being adjustable between a first and a second width, and a fourth support beam spaced from the third support beam with the fourth support beam extending transverse to the longitudinal axis and being adjustable between the first and second widths. The storage apparatus further comprises a plurality of cross beams each coupled to at least one of the support beams. The storage apparatus further comprises a plurality of suspension legs coupled to and extending away from at least two of the support beams for coupling to the surface. The storage apparatus further comprises a plurality of racks each supported on at least a portion of the support beams with the plurality of racks defining a first series of racks aligned transverse to the longitudinal axis and a second series of racks aligned along the longitudinal axis with the first series being removable during adjustment of the first and second support beams along the longitudinal axis and the second series being removable during adjustment of the third and fourth support beams transverse to the longitudinal axis.

Also disclosed is a storage apparatus attachable to a surface comprising a polygonal support frame having a first support beam defining a longitudinal axis and being adjustable along the longitudinal axis between a first and a second length, a second support beam extending along the longitudinal axis and being adjustable along the longitudinal axis between the first and second lengths, a third support beam extending transverse to the longitudinal axis, and a fourth support beam spaced from the third support beam and extending transverse to the longitudinal axis. The storage apparatus further comprises a plurality of cross beams each coupled to at least one of the support beams. The storage apparatus further comprises a plurality of suspension legs coupled to and extending away from at least two of the support beams for coupling to the surface. The storage apparatus further comprises a plurality of rack segments supported on at least a portion of the support beams and the cross beams with the rack segments being removable during adjustment along the longitudinal axis. Further, the first support beam has first and second predefined mounting locations along the first support beam with the first mounting location defining an extended position of the first support beam having the first length and the second mounting location defining an adjusted position of the first support beam having the second length. The second support beam has third and fourth predefined mounting locations along the second support beam with the third mounting location defining an extended position of the second support beam having the first length and the fourth mounting location defining an adjusted position of the second support beam having the second length. The storage apparatus further comprising fasteners disposed only through the first and second support beams at the first and third mounting locations when the first and second support beams are in the extended position, and disposed only through the first and second support beams at the second and fourth mounting locations when the first and second support beams are in the adjusted position.

Also disclosed is a storage apparatus attachable to a surface comprising a polygonal support frame having a first support beam defining a longitudinal axis with the first support beam defining a plurality of slots at predetermined positions along the first support beam, a second support beam extending along the longitudinal axis with the second support beam defining a plurality of slots at predetermined positions along the second support beam, a third support beam extending transverse to the longitudinal axis, and a fourth support beam spaced from the third support beam and extending transverse to the longitudinal axis. The storage apparatus further comprises a rack supported on the support frame, a plurality of suspension legs coupled to and extending away from at least two of the support beams for coupling to the surface, and a plurality of cross beams each having first and second cross beam ends with each cross beam having a first tab coupled to an associated first cross beam end and insertable into a respective one of the first slots to mount the cross beam to the first support beam and each cross beam further having a second tab coupled to an associated second cross beam end and insertable into a respective one of the second slots to mount the cross beam to the second support beam.

BRIEF DESCRIPTION OF THE DRAWINGS

The advantages of the present disclosure will be readily appreciated as the same becomes better understood by reference to the following detailed description when considered in connection with the accompanying drawings. It is to be understood that the drawings are purely illustrative and that the drawings are not necessarily drawn to scale.

DETAILED DESCRIPTION

Figure 1:
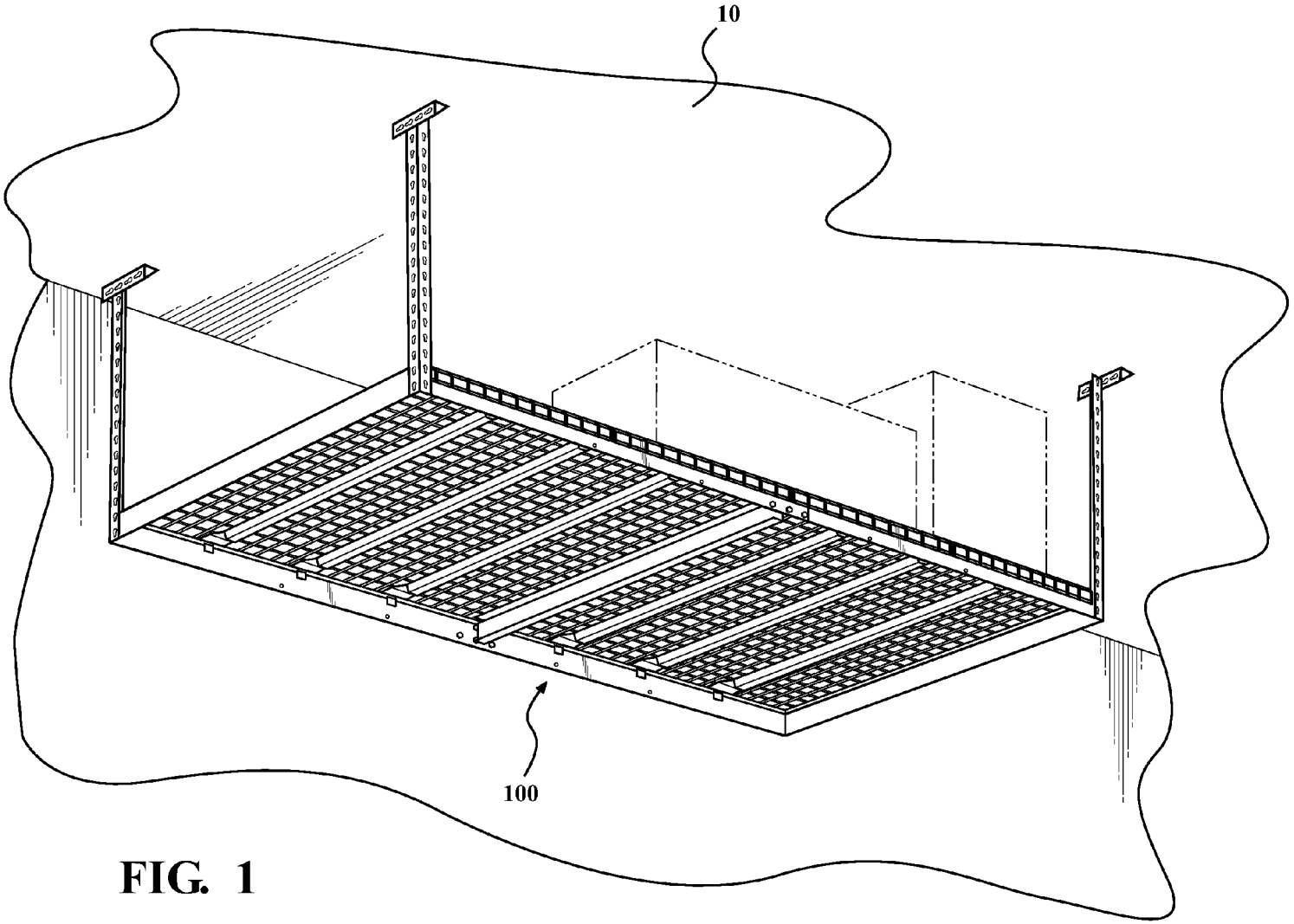
FIG. 1 shows an embodiment of a storage apparatus attached to a surface.

Referring now to the figures, wherein like numerals indicate corresponding parts throughout the several views, embodiments of the storage apparatus 100, 200 are shown in the figures and are described in detail below. As shown in FIG. 1, the storage apparatus 100, 200 is attachable to a surface 10, such as a ceiling, a floor, a wall, a surface of a tangible or intangible object, and/or the like. In a particular embodiment, the storage apparatus 100, 200 is attachable to a ceiling of a building, such as a ceiling of a garage of a house, a ceiling of warehouse, a ceiling in a storage room, etc. The storage apparatus 100, 200 is easily adjustable in multiple dimensions, such as adjustable in length and/or width. Further, the storage apparatus 100, 200 is capable of suitably holding and/or supporting at least one item, which may be placed and/or stacked on the apparatus 100, 200.

An embodiment of the storage apparatus 100 is described below with reference to FIGS. 2-19. The storage apparatus 100 comprises a polygonal support frame 102 having first 104, second 106, third 108, and fourth 110 support beams. The first support beam 104 defines a longitudinal axis A and is adjustable along the longitudinal axis A between a first length $L_1$ and a second length $L_2$. The second support beam 106 is spaced from the first support beam 104 with the second support beam 106 extending along the longitudinal axis A and is adjustable along the longitudinal axis A between the first length $L_1$ and the second length $L_2$. The third support beam 108 extends transverse to the longitudinal axis A. The fourth support beam 110 is spaced from the third support beam 108 and extends transverse to the longitudinal axis A.

Each of the first 104 and second 106 support beams may be formed from a metal, metal alloy, a polymer, and/or combinations thereof. Each of the first 104 and second 106 support beams also has outer 112 and inner 114 surfaces with the surfaces 112, 114 positioned substantially parallel to each other. In an embodiment, and as shown, each of the first 104 and second 106 support beams has a base 116 including the outer 112 and inner 114 surfaces, and further has a wall 118 extending substantially perpendicularly from the inner surface 114. Accordingly, the base 116 and the wall 118 are arranged such that the first 104 and second 106 support beams have an L-shape. It is to be understood that the first 104 and second 106 support beams may have any suitable alternative configuration. In an example, the first 104 and second 106 support beams may have the base 116 and the wall 118 arranged such that the wall 118 extends from the base 116 at an angle other than perpendicular. Further, the wall 118 may be integrally formed to the base 116 or may be coupled to the base 116, such as by welding, soldering, brazing, utilizing a suitable adhesive, and/or the like.

In an embodiment, the first 104 and second 106 support beams are adjustable for adjusting the length of the apparatus 100. For example, and as shown, the first support beam 104 has first 115 and second 117 support beam pieces and the second support beam 106 has first 119 and second 121 support beam pieces. The first support beam piece 115, 119 of the first 104 and second 106 support beams is slidable relative to the second support beam piece 117, 121 for adjusting the support beams 104, 106. For example, the first 115 and second 117 pieces of the first support beam 104 may telescope such that the first 115 and/or second 117 pieces move relative to the other piece 115, 117, and the first 119 and second 121 pieces of the second support beam 106 may telescope such that the first 119 and/or second 121 pieces move relative to the other piece 119, 121.

The first support beam 104 further has first 120 and second 122 predefined mounting locations along the first support beam 104. The first mounting location 120 defines an extended position of the first support beam 104 having the first length $L_1$ and the second mounting location 122 defines an adjusted position of the first support beam 104 having the second length $L_2$. The second support beam 106 has third 124 and fourth 126 predefined mounting locations along the second support beam 106. The third mounting location 124 defines an extended position of the second support beam 106 having the first length $L_1$ and the fourth mounting location 126 defines an adjusted position of the second support beam 106 having the second length $L_2$. The apparatus 100 further comprises at least one fastener 128 disposed through the first support beam 104 at the first mounting location 120 when the first support beam 104 is in the extended position, and at least one fastener 128 disposed through the first support beam 104 at the second mounting location 122 when the first support beam 104 is in the adjusted position. Further, at least one fastener 128 is disposed through the second support beam 106 at the third mounting location 124 when the second support beam 106 is in the extended position, and at least one fastener 128 is disposed through the second support beam 106 at the fourth mounting location 126 when the second support beam 106 is in the adjusted position. In an embodiment, the first support beam 104 may define apertures 130 at the first mounting location 120 for receiving the fasteners 128 when the first support beam 104 is in the extended position, and the second support beam 106 may define apertures 132 at the third mounting location 124 for receiving the fasteners 128 when the second support beam 106 is in the extended position. In an embodiment, fasteners 128 are disposed only through the first 104 and second 106 support beams at the first 120 and third 124 mounting locations when the first 104 and second 106 support beams are in the extended position. Further, the first support beam 104 may define aperture 134 at the second mounting location 122 for receiving the fasteners 128 when the first support beam 104 is in the adjusted position, and the second support beam 106 may define apertures 136 at the fourth mounting location 126 for receiving the fasteners 128 when the second support beam 106 is in the adjusted position. In an embodiment, fasteners 128 are disposed only through the first 104 and second 106 support beams at the second 122 and fourth 126 mounting locations when the first 104 and second 106 support beams are in the adjusted position.

The first 104 and second 106 support beams may define any number of apertures 130, 132 at the first 120 and third 124 mounting locations, respectively. In the embodiment shown, each of the first 104 and second 106 support beams define four apertures 130, 132 at each of the first 120 and third 124 mounting locations, respectively. Additionally, where each of the first 104 and second 106 support beams are L-shaped (for example, each of the beams 104, 106 have a base 116 and a wall 118 extending substantially perpendicularly to the base 116), the base 116 may have four apertures 130, 134 at each of the first 120 and third 124 mounting locations, respectively, and the wall 118 may have two apertures 130, 134 at least of the first 120 and third 124 mounting locations, respectively. Further, the first 104 and second 106 support beams may define any number of apertures 134, 136 at the second 122 and fourth 126 mounting locations, respectively. The number of apertures 134, 136 at the second 122 and fourth 126 mounting locations may be the same or different than the number of apertures 130, 132 at the first 120 and third 124 mounting locations. Further, the apertures 130, 132, 134, and 136 may have any suitable arrangement.

Additionally, and in an embodiment, the apparatus 100 further includes a plurality of fasteners 128 securing each of the third 108 and fourth 110 support beams to the first 104 and second 106 support beams.

The fasteners 128 may be any suitable fastener disposed through the first 104 and second 106 support beams may be any suitable fasteners. In an example, each of the fasteners 128 is a nut and bold assembly. In another example, the fasteners 128 may include bolts, screws, dowels, pins, and/or the like that can be suitably disposed through the apertures 130, 132, 134, 136. In yet another example, other fasteners (such as clamps) that may be used as an alternative or in addition to the fasteners 128.

Each of the first 104 and second 106 support beams may further comprise a plurality of first 125 and second 127 slots, respectively. The first slots 125 are defined by the first support beam 104 at predetermined positions along the first support beam 104. The second slots 127 are defined by the second support beam 106 at predetermined positions along the second support beam 106. The first 125 and second 127 slots are configured to receive first 144 and second 146 tabs coupled to first 140 and second 142 ends of cross beams 138, as described in further detail below. In an example, the first 125 and second 127 slots defined in the first 104 and second 106 support beams are spaced substantially equally along the first 104 and second 106 support beams. In another example, the first 125 and second 127 slots are positioned along the first 104 and second 106 support beams such that the distance between adjacent slots 125, 127 vary along the first 104 and second 106 support beams. Further each of the first 125 and second 127 slots are sized and shaped to receive the first 140 and second 142 tabs. Further, the slots 125, 127 may be rectangular, square-shaped, circular, oval, etc. In an embodiment, and as shown, each of the slots 125, 127 extend through the support beams 104, 106.

The storage apparatus 100 further comprises a plurality of cross beams 138 which may be formed from any suitable material, such as a metal, metal alloy, a polymer, and/or combinations thereof. Each cross beam 138 is coupled to at least one of the support beams 104, 106, 108, 110. In an embodiment, and as shown, each cross beam 138 is coupled to the first support beam 104 and the second support beam 106. In an embodiment, each cross beam 138 is substantially perpendicular to both the first support beam 104 and the second support beam 106. Alternatively, one or more of the cross beams 138 may be coupled to the first 104 and second 106 support beams and may extend from each of the support beams 104, 106 at an angle other than a right angle. In another embodiment, the storage apparatus 100 may include cross beams 138 coupled to the first 104 and second 106 support beams, as well as cross beams 138 coupled to the third 108 and fourth 110 support beams. In still another embodiment, the storage apparatus 100 may include cross beams 138 coupled to the third 108 and fourth 110 support beams, and no cross beams 138 coupled to the first 104 and second 106 support beams.

In an embodiment, and as shown, each of the cross beams 138 is spaced substantially the same distance from an adjacent one of the cross beams 138. In an alternative embodiment, one or more of the cross beams 138 the distance between adjacent cross beams 138 may vary. Further, the apparatus 100 may include any number of cross beams 138. In one example, the apparatus 100 includes seven cross beams 138. In another example, the apparatus 100 includes six cross beams 138. While the number of cross beams 138 is unlimited, the length (or width) of the polygonal support frame 102 typically dictates the number of cross beams 138 utilized in the apparatus 100.

Each of the cross beams 138 may have any configuration, such as a rectangular configuration, a circular configuration (similar to a rod), a triangular configuration, a hexagonal configuration, etc. Further, the cross beams 138 may be hollow or solid. In an embodiment, each cross beam 138 has a cross beam ends 140, 142 with a first tab 144 coupled to the first cross beam end 140 and a second tab 146 coupled to the second cross beam end 142. The first tab 144 of each of the cross beams 138 is insertable into a respective one of the first slots 125 defined at predetermined positions along the first support beam 104. Further, the second tab 144 of each of the cross beams 138 is insertable into a respective one of the second slots 127 defined at predetermined positions along the second support beam 106.

In an embodiment, the apparatus 100 further includes a fifth support beam 148 extending transverse to the longitudinal axis A. As shown, the fifth support beam 148 is positioned at substantially the center point of the length $L_1$ of the first 104 and second 106 support beams when in the extended position. The fifth support beam 148 may otherwise be positioned in any desirable location along the length $L_1$. In an example, the fifth support beam 148 is coupled to the first 104 and second 106 support beams with at least one fastener 128. For example, the fifth support beam 148 may have first 150 and second 152 ends and aperture(s) 154 defined in each of the ends 150, 152. Further, the first 104 and second 106 support beams may include additional aperture(s) 156 which are aligned with the aperture(s) 154 of the fifth support beam 148, and the fastener(s) 128 may be disposed through the aligned apertures 154, 156 to couple the fifth support beam 148 to the first 104 and second 106 support beams.

The fifth support beam 148 may have any configuration, such as a rectangular configuration, a circular configuration (similar to a rod), a triangular configuration, a hexagonal configuration, etc. The fifth support beam 148 may be hollow or solid. Further, the fifth support beam 148 may be formed from any suitable material, such as a metal, metal alloy, a polymer, and/or combinations thereof.

The apparatus 100 further includes a plurality of rack segments 158 supported on at least a portion of the support beams 104, 106, 108, and 110. In an example, at least one of the rack segments 158 is also supported on at least a portion of the fifth support beam 148. The rack segments 158 are removable during adjustment of the apparatus 100 along the longitudinal axis A. For example, the rack segments 158 may be aligned along the longitudinal axis A, and one or more of the rack segments 158 may be removed to adjust the apparatus 100 from the first length $L_1$ to the second length $L_2$. Said differently, one or more of the rack segments 158 may be removed to shorten the length of the apparatus 100.

Each of the rack segments 158 may be a solid sheet of material, such as a solid sheet of metal, metal alloy, a polymer, and/or combinations thereof. Alternatively, and as shown, each of the rack segments 158 may be a wire mesh. Further, each of the rack segments 158 may have any suitable shape or configuration, such as a rectangular shape, a square shape, etc. As shown, each of the rack segments 158 has a rectangular shape. Further, each of the rack segments 158 have a lip 160 at opposing ends 162, 164 which are configured to wrap around the first 104 and second 106 support beams when the rack segments 158 are supported by the polygonal support frame 102. Alternatively, each of the rack segments 158 are positioned on and/or coupled to the polygonal support frame 102 such that the rack segments 158 are not movable during use of the apparatus 100. In an example, the rack segments 158 may be independently supported on the polygonal support frame 102 or one or more of the rack segments 158 may be coupled to an adjacent rack segment 158 utilizing, for example, a clip or other suitable fastener.

In an embodiment, the apparatus 100 further includes a plurality of suspension legs 166 coupled to and extending away from at least two of the support beams 104, 106, 108, 110 for coupling to the surface 10. In an example, the apparatus 100 includes a suspension leg 166 coupled to each of the support beams 104, 106, 108, 110. In another example, the apparatus 100 includes two suspension legs 166 coupled each end of the first support beam 104 and two suspension legs 166 coupled to each end of the second support beam 106. In still another example, the apparatus 100 includes two suspension legs 166 coupled to each end of the third support beam 108 and two suspension legs 166 coupled to each end of the fourth support beam 110. It is to be understood that the apparatus 100 may have as many suspension legs as desired and the suspension legs 166 may be coupled to any two or more of the support beams 104, 106, 108, 110.

The suspension legs 166 may be formed of any material, such as a metal, a metal alloy, a polymer, and/or combinations thereof. The suspension legs 166 may also have any suitable shape and may be solid or hollow. In an embodiment, the suspension legs 166 are adjustable to adjust a height of the apparatus 100 when attached to the surface 10.

For example, each of the suspension legs 166 may have two telescoping pieces that enable adjustment of the suspension legs 166 for adjusting the height of the apparatus 100. Further, each of the suspension legs 166 has an end 168 for attaching the suspension leg 166 to the surface 10. Attachment of the suspension legs 166 to the surface 10 may be accomplished utilizing fasteners, such as bolts, screws, and/or the like.

Figure 2:
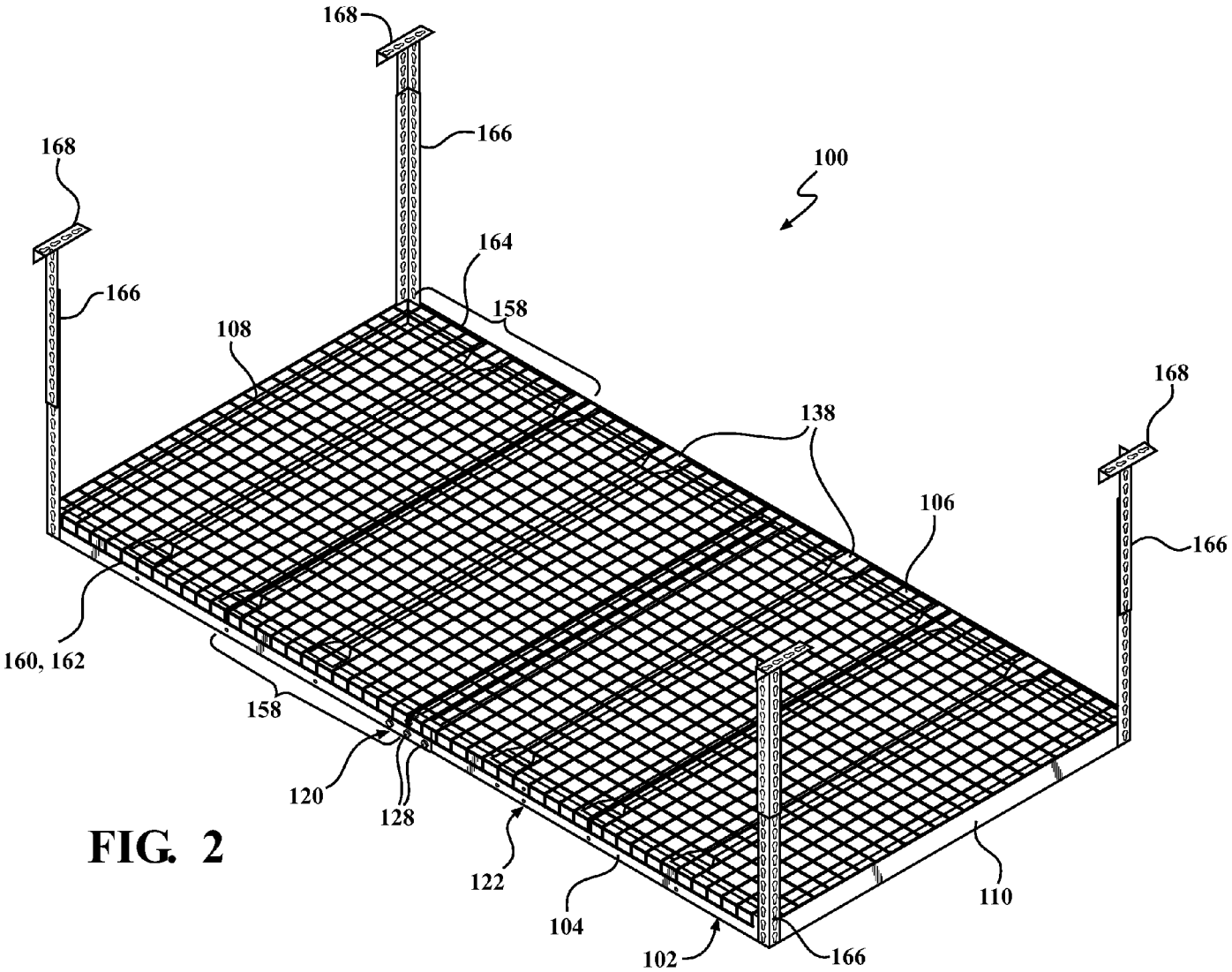
FIG. 2 is a perspective view of an embodiment of the storage apparatus in an extended position.
Figure 3:
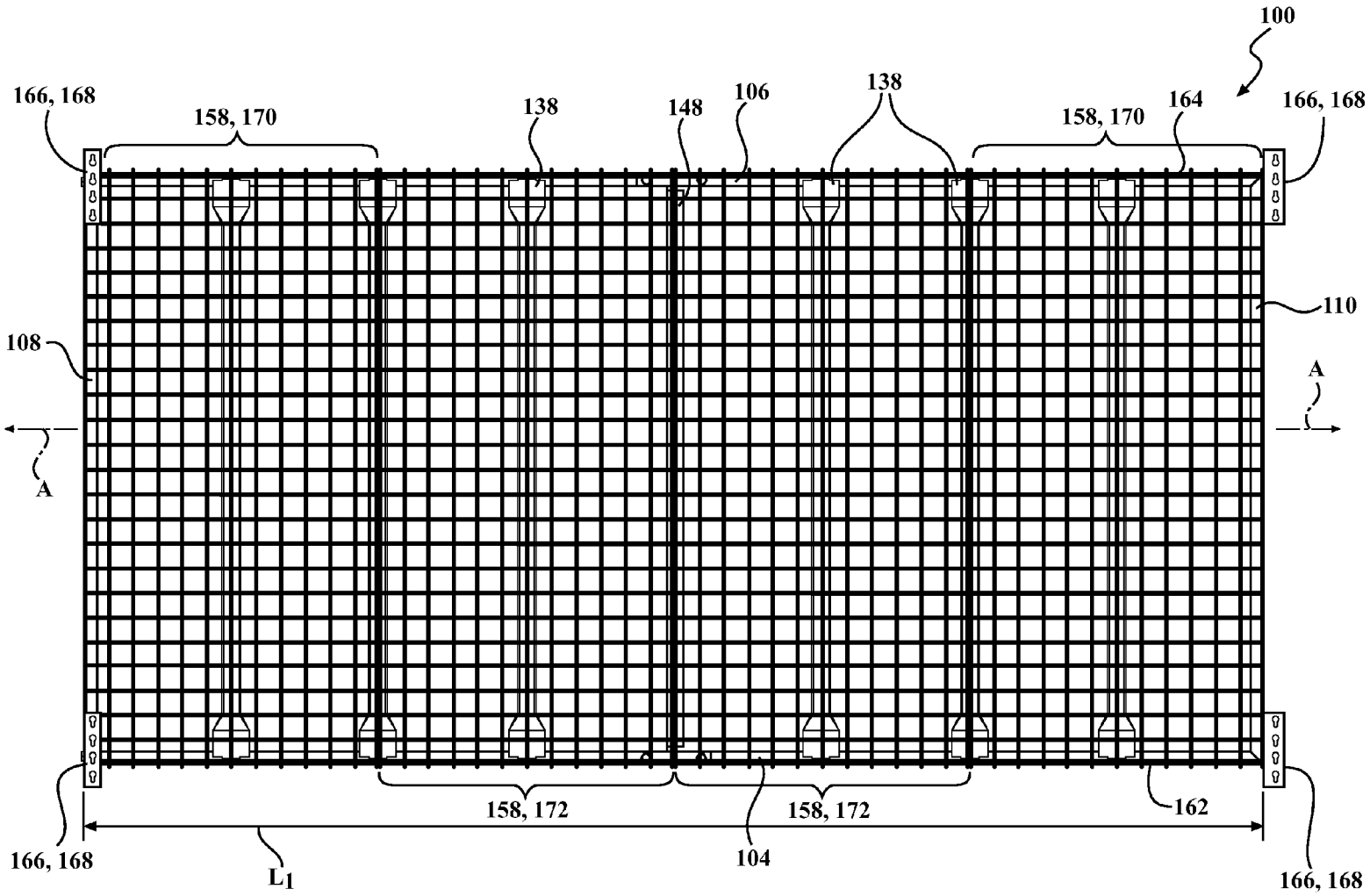
FIG. 3 is a top plan view of the storage apparatus of FIG. 2.
Figure 4:
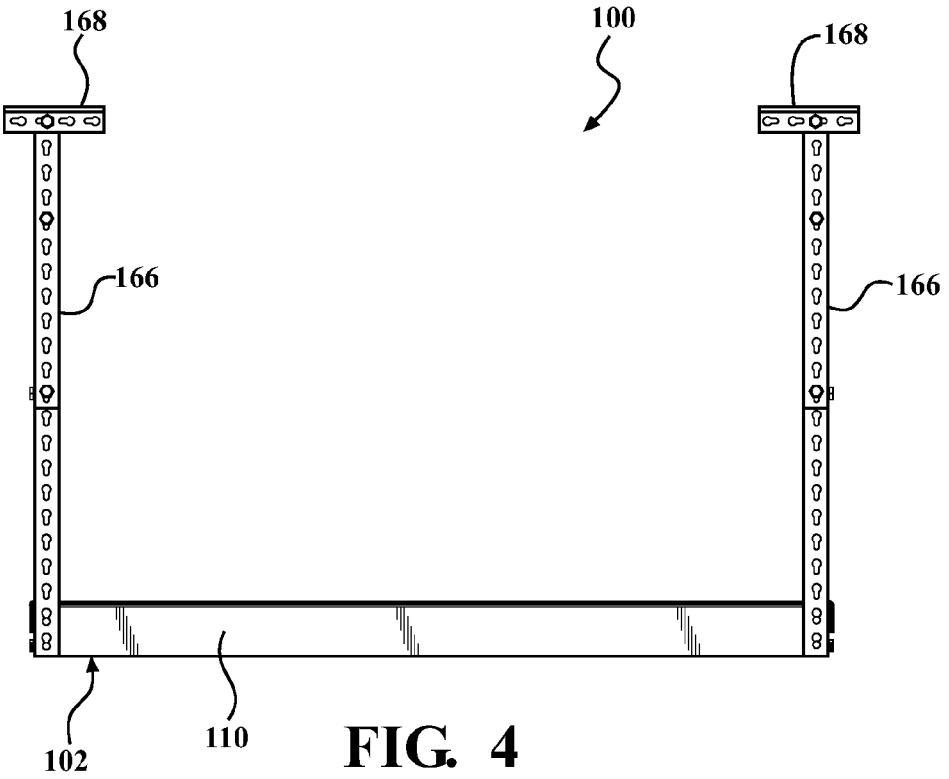
FIG. 4 is a right side view of the storage apparatus of FIG. 2.
Figure 5:
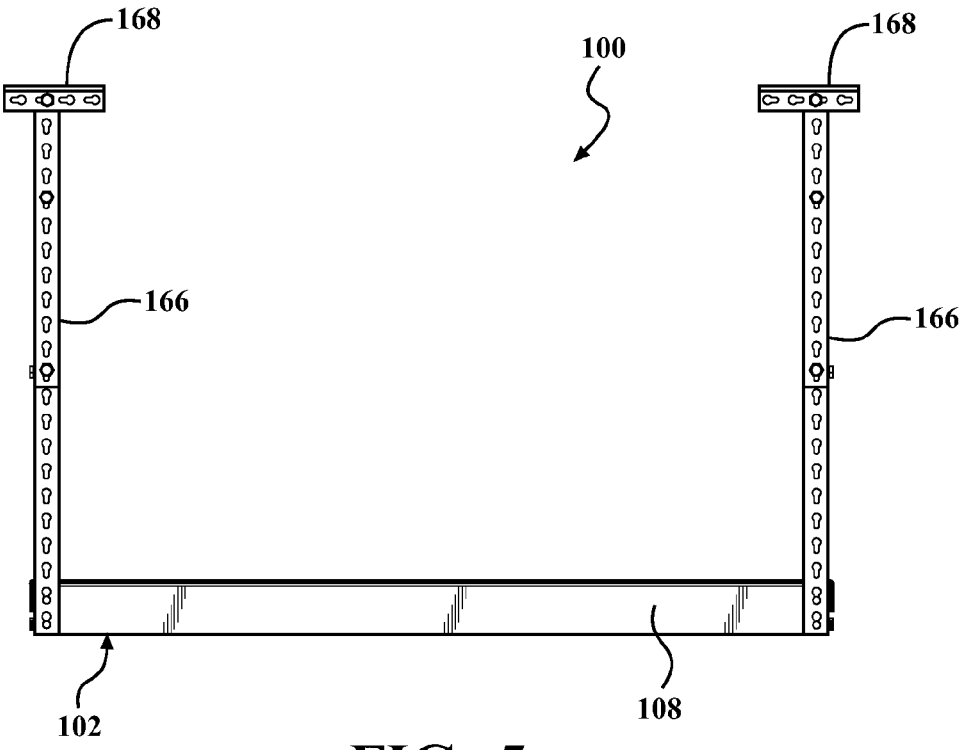
FIG. 5 is a left side view of the storage apparatus of FIG. 2.
Figure 6:
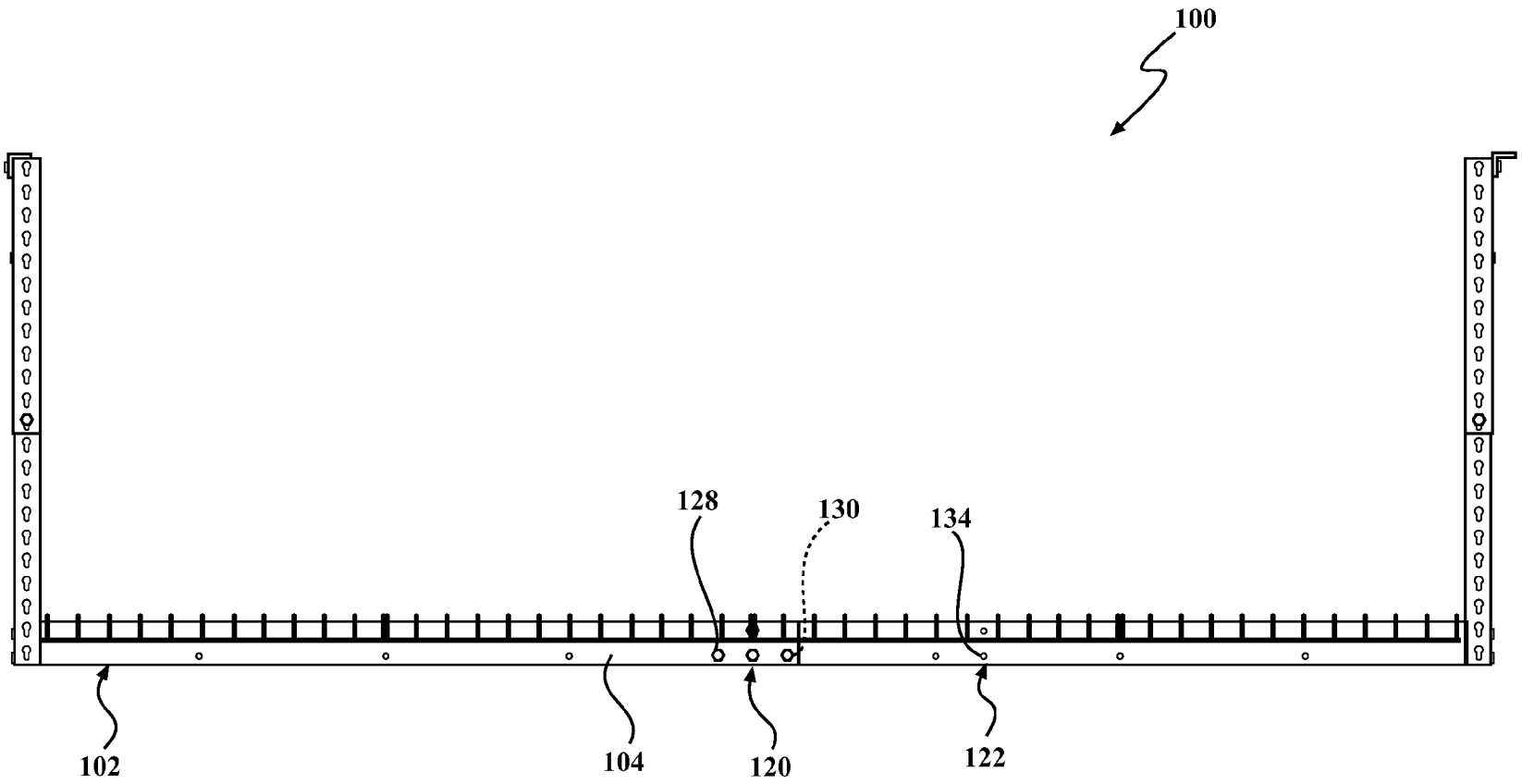
FIG. 6 is a front view of the storage apparatus of FIG. 2.
Figure 7:
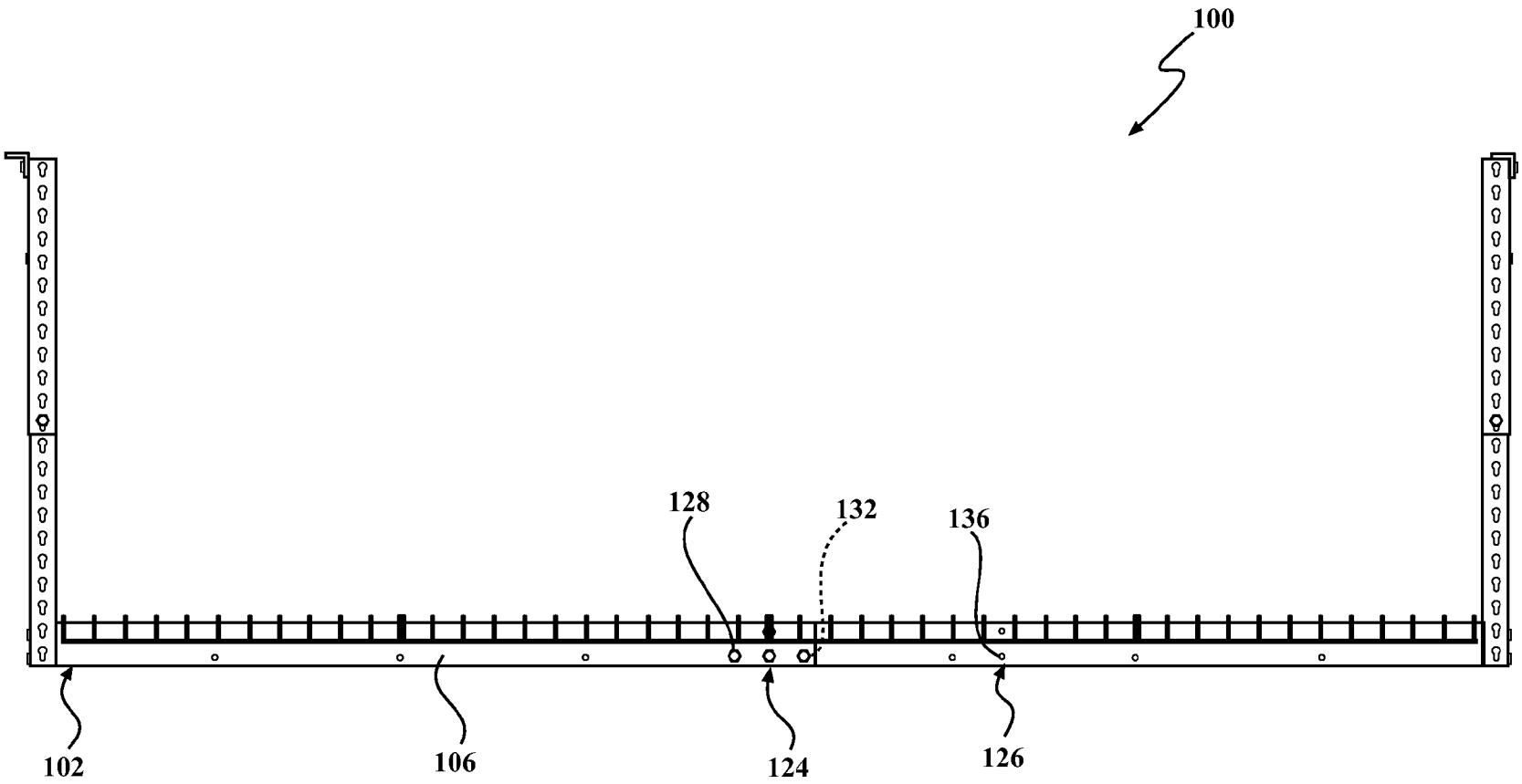
FIG. 7 is a rear view of the storage apparatus of FIG. 2.
Figure 8:
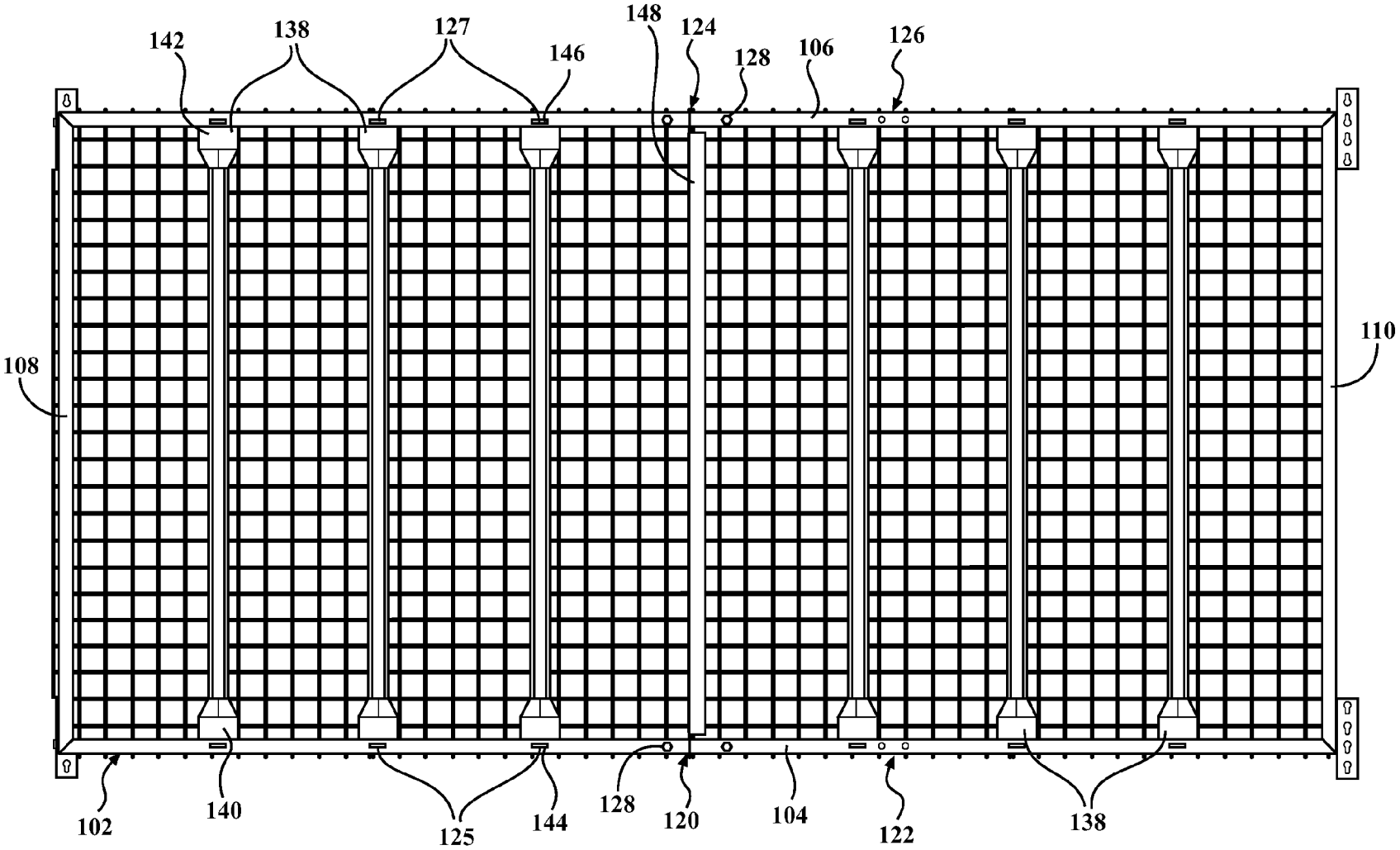
FIG. 8 is a bottom plan view of the storage apparatus of FIG. 2.
Figure 9:
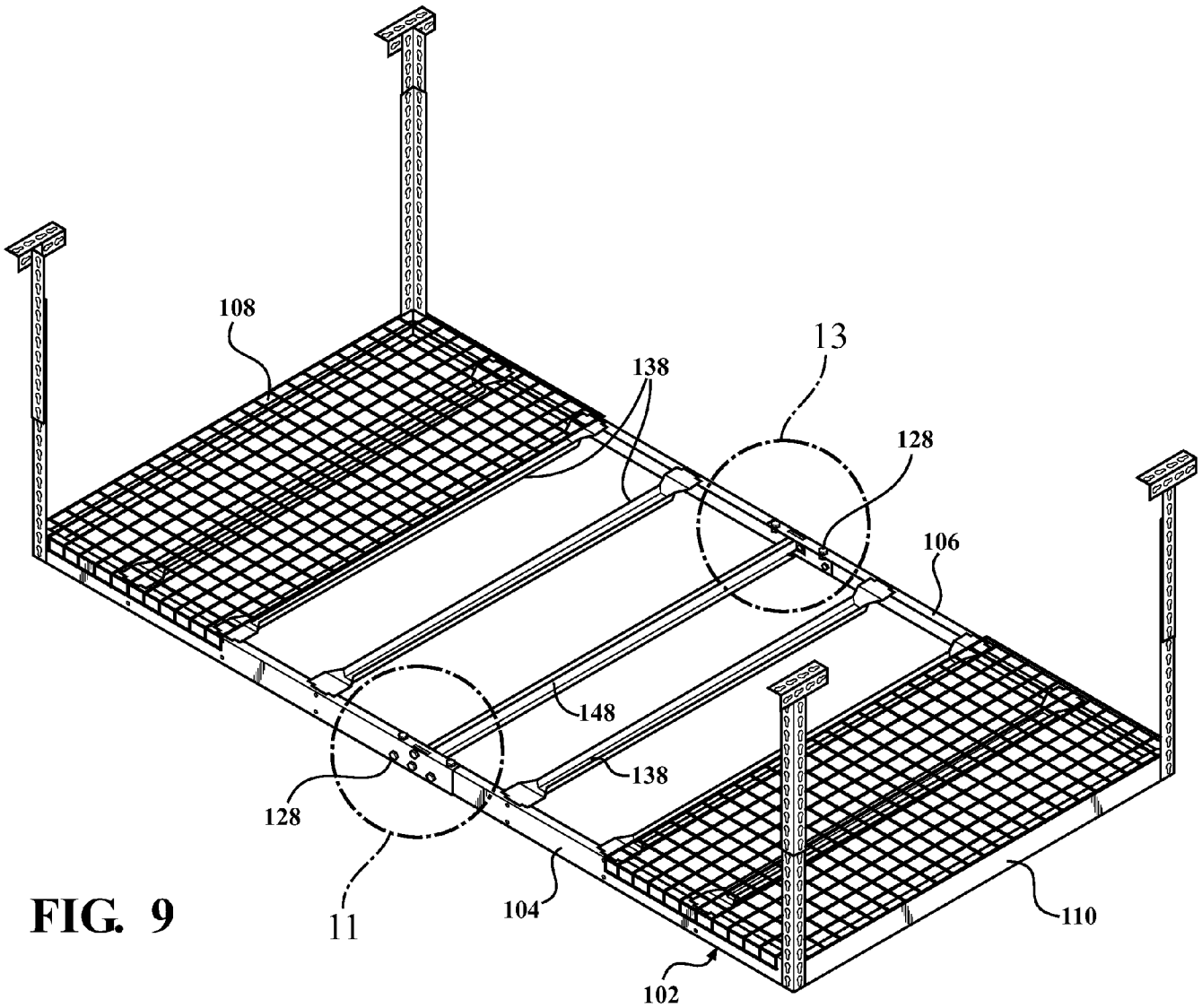
FIG. 9 is a perspective view of the storage apparatus of FIG. 2 with two rack segments removed to expose a portion of a polygonal support frame and a plurality of cross beams.
Figure 10:
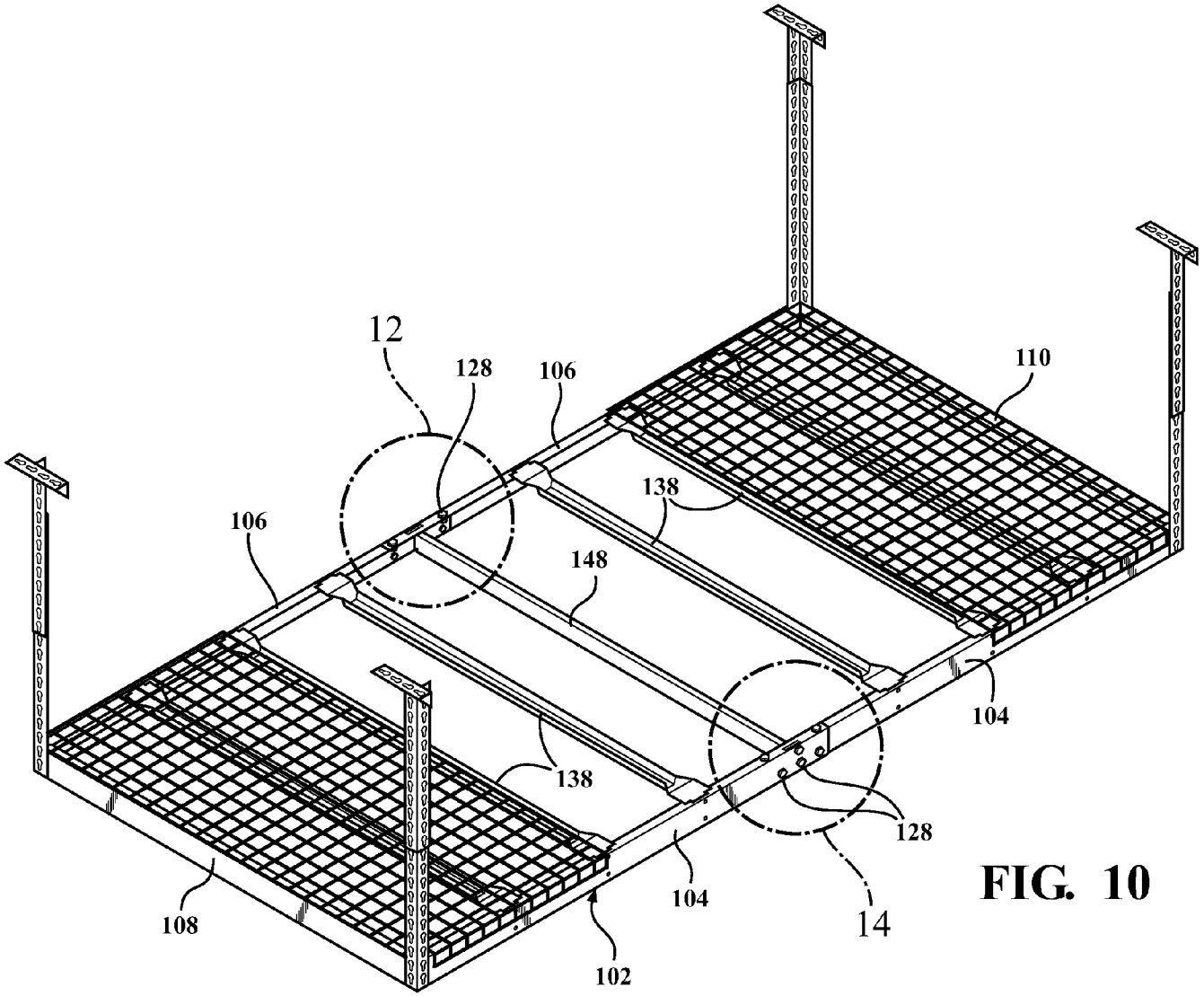
FIG. 10 is another perspective view of the storage apparatus of FIG. 2 with two rack segments removed to expose a portion of a polygonal support frame and a plurality of cross beams.
Figure 11:
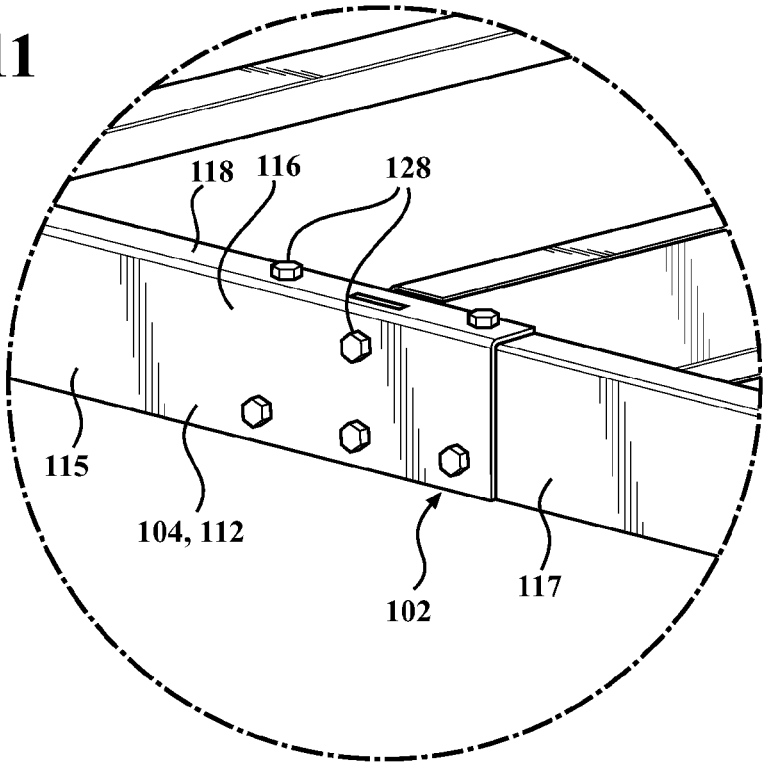
FIG. 11 is an enlarged view of a portion of a first support beam of the polygonal support frame of the storage apparatus shown in FIG. 9.
Figure 12:
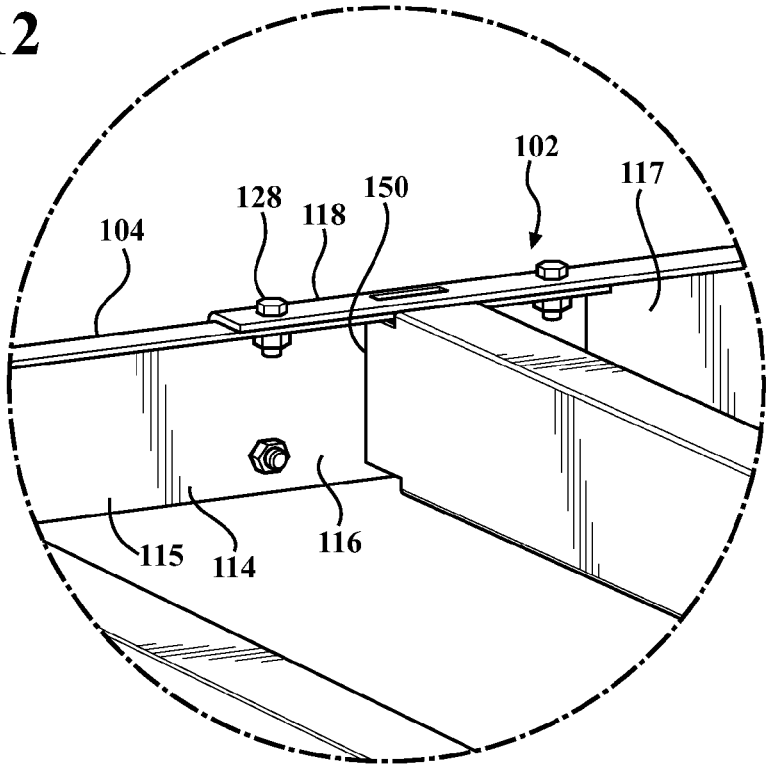
FIG. 12 is an enlarged view of a portion of the first support beam of the polygonal support frame and a fifth support beam coupled to the first support beam of the storage apparatus shown in FIG. 10.
Figure 13:
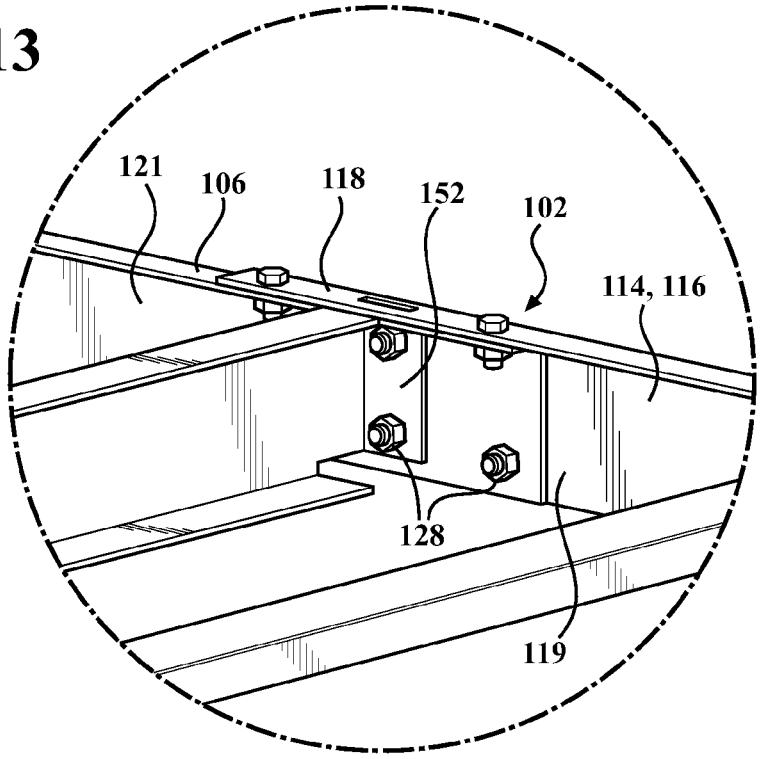
FIG. 13 is an enlarged view of a portion a second support beam of the polygonal support frame and the fifth support beam coupled to the second support beam of the storage apparatus shown in FIG. 9.
Figure 14:
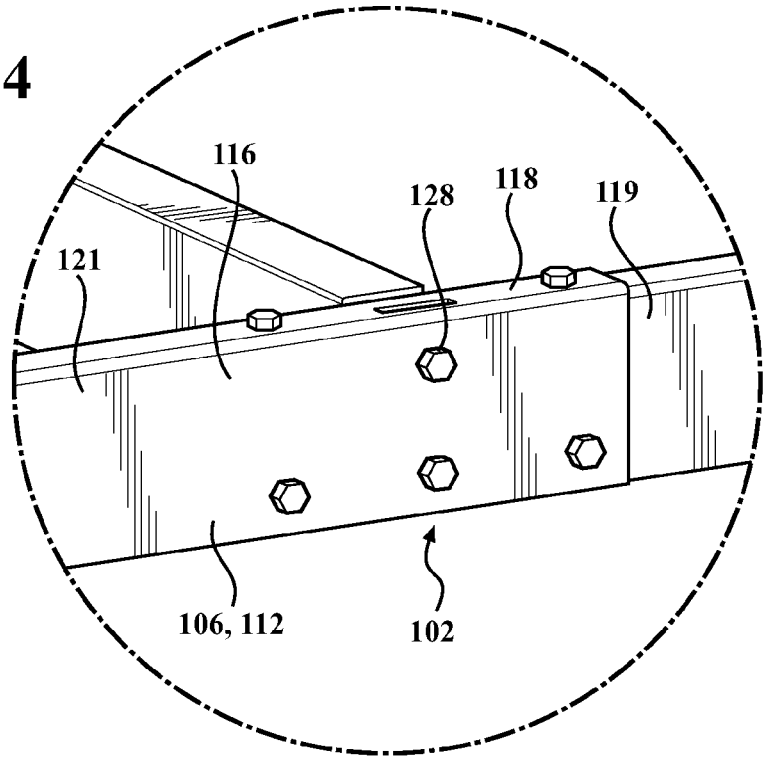
FIG. 14 is an enlarged view of a portion of the second support beam of the polygonal support frame of the storage apparatus shown in FIG. 10.
Figure 15:
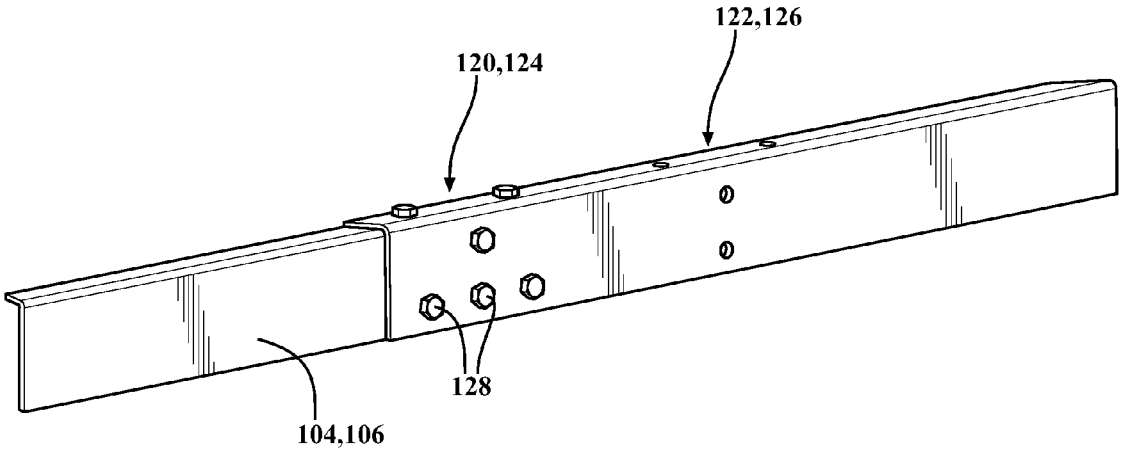
FIG. 15 is a front perspective view of a fragment of one of the first and second support beams of the polygonal support frame of the storage apparatus of FIG. 2.
Figure 16:
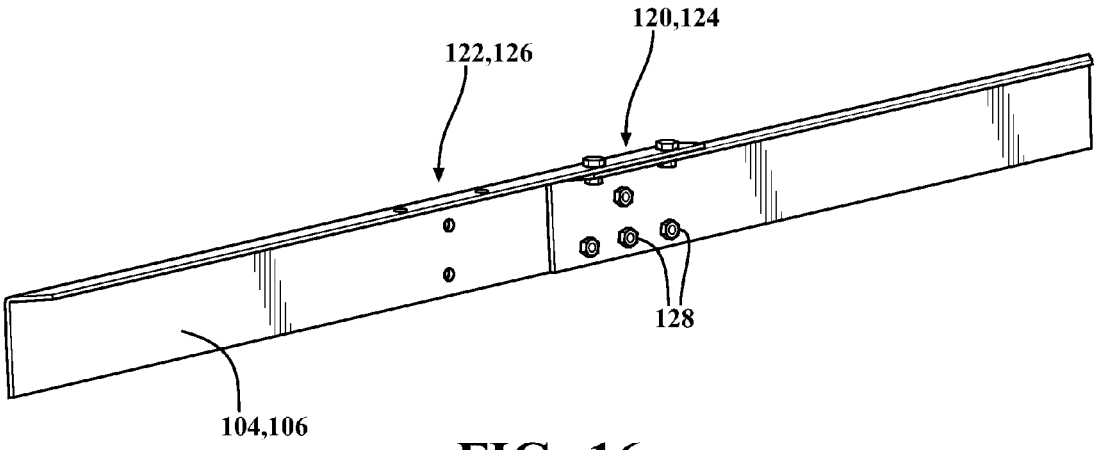
FIG. 16 is a rear perspective view of a fragment of the one of the first and second support beams of the polygonal support frame of the storage apparatus of FIG. 2.
Figure 17:
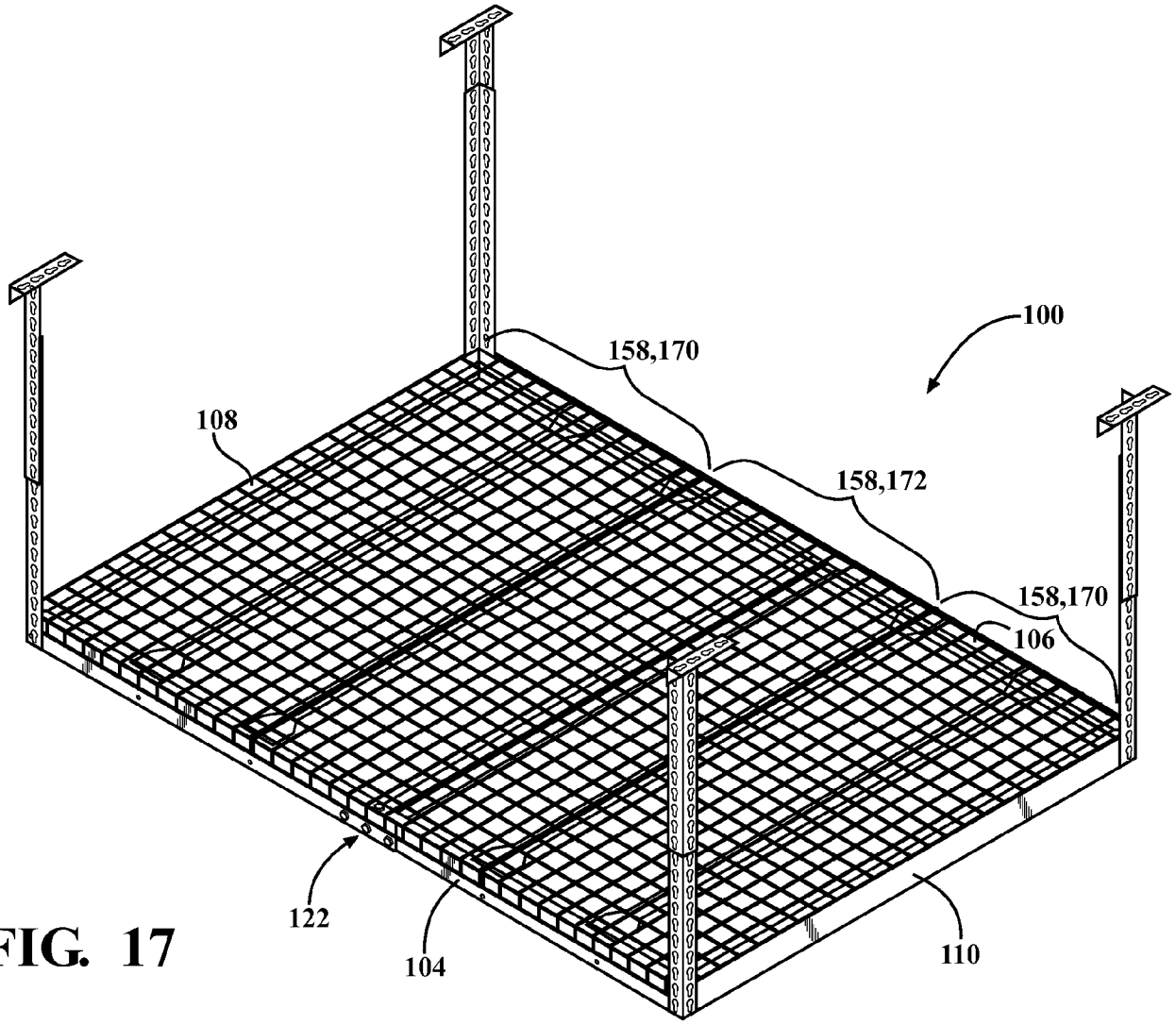
FIG. 17 is a perspective view of the storage apparatus of FIG. 2 in an adjusted position relative to its length.
Figure 18:
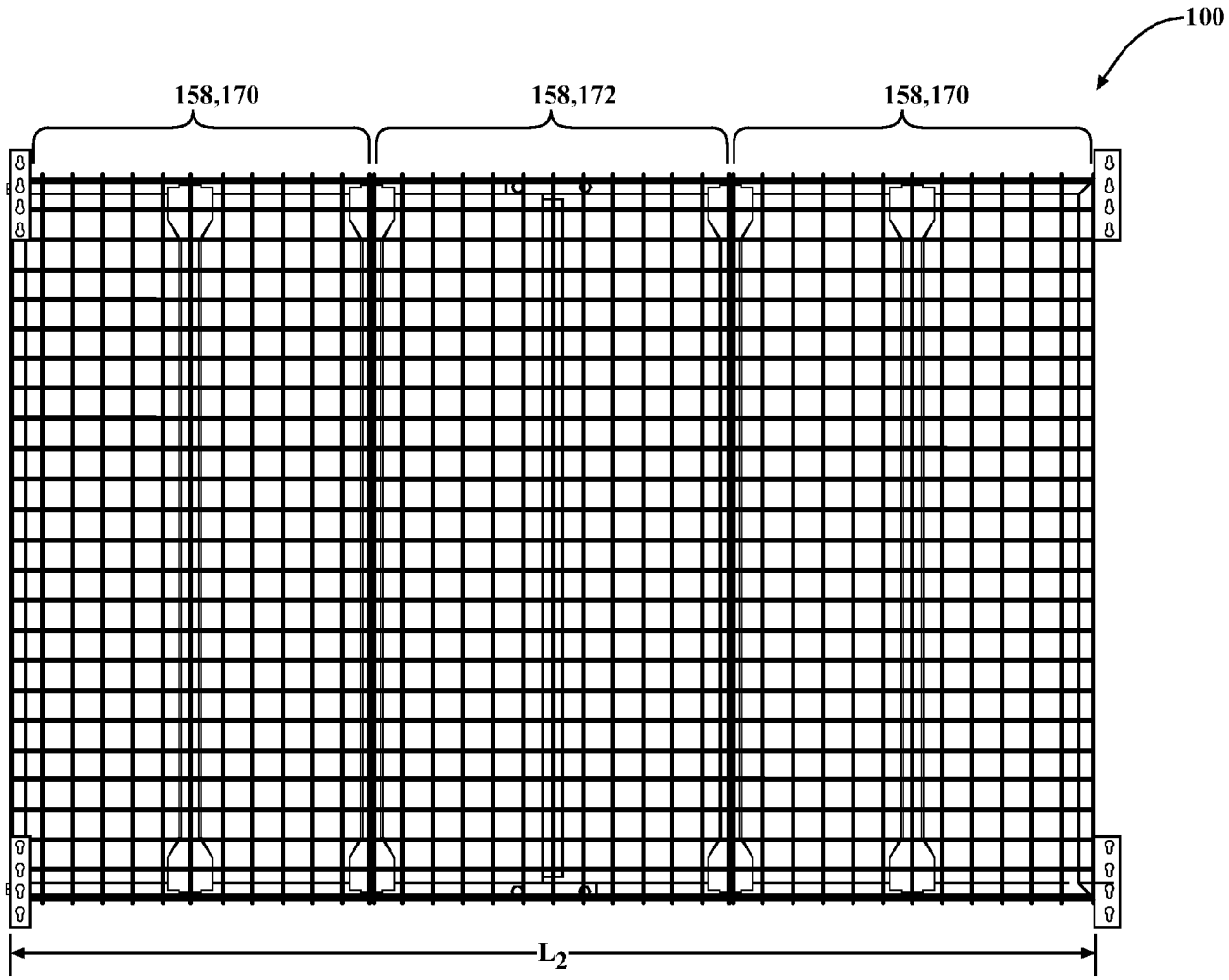
FIG. 18 is a top plan view of the adjusted storage apparatus shown in FIG. 17.
Figure 19:
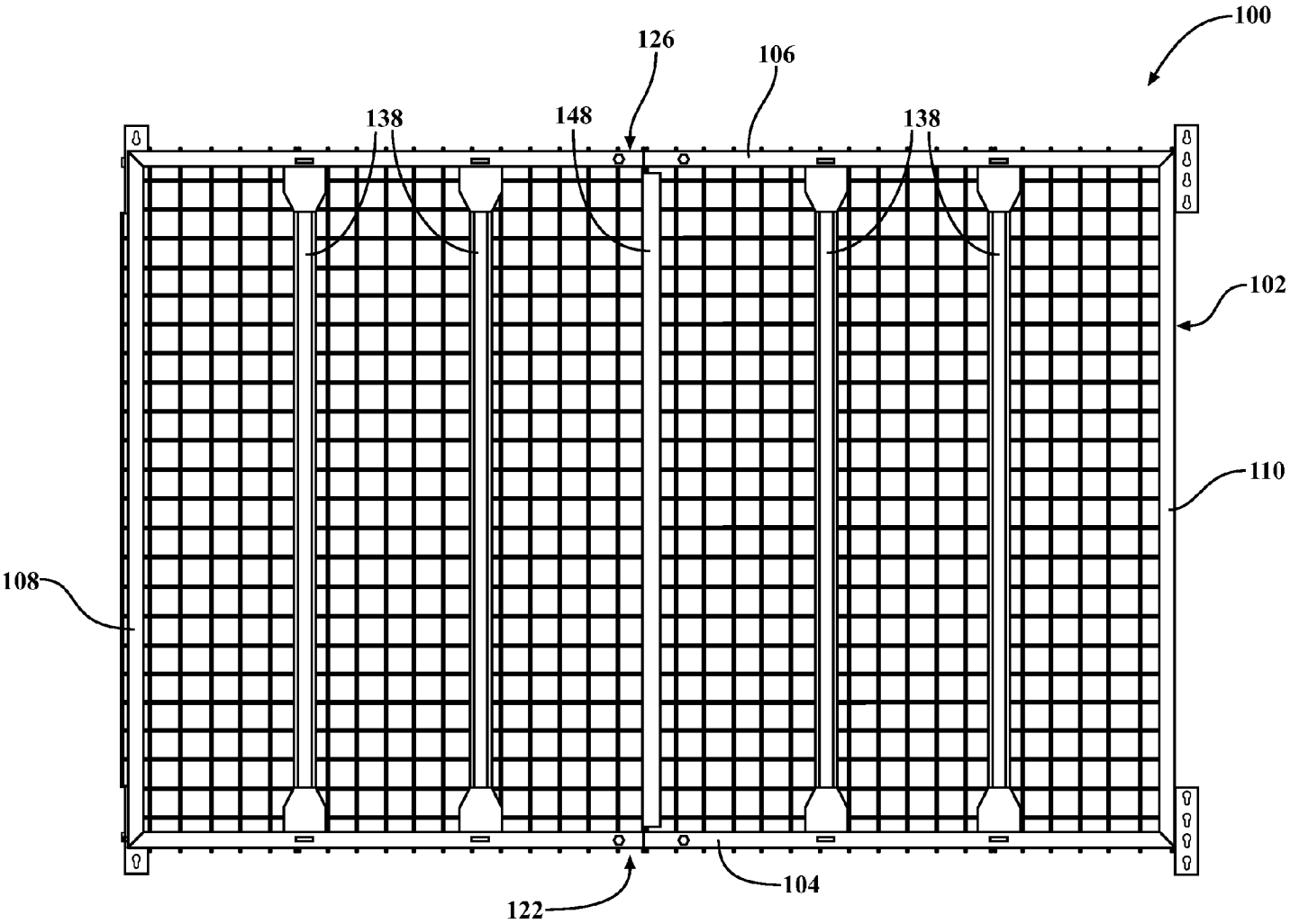
FIG. 19 is a bottom plan view of the adjusted storage apparatus shown in FIG. 17.

In an example, the apparatus 100 is in the extended position when the apparatus 100 is at its full length (i.e., the support beams 104, 106 have the first length $L_1$). In the extended position, as shown in FIG. 2 for example, the apparatus 100 includes four rack segments 158 aligned along the longitudinal axis A. The apparatus 100 may be attached to the surface 10 when in the extended position. In another example, the apparatus 100 is in the adjusted position when the apparatus 100 is at an adjusted length (i.e., the support beams 104, 106 have the second length $L_2$). The adjusted length may be the length of the apparatus 100 when one of the rack segments 158 is removed. The adjusted length may otherwise be the length of the apparatus 100 when two or more of the rack segments 158 are removed. In an embodiment, the plurality of rack segments 158 includes exterior 170 and interior 172 rack segments, and at least one of the interior rack segments 172 is removable during adjustment of the first 104 and second 106 support beams. Accordingly, adjustment of the apparatus 100 may be accomplished by removing at least one of the interior rack segments 172, removing the fasteners 128 disposed through the first 104 and second 106 support beams at the respective first 120 and third 124 mounting locations, adjusting the first 104 and second 106 support beams, and disposing the fasteners 128 through the beams 104, 106 at the respective second 122 and fourth 126 mounting locations. The adjusted apparatus 100 (as shown, for example, in FIGS. 17-19) may then be attached to the surface 10, for example, by attaching the suspension legs 166 to the surface 10 utilizing fasteners 128.

Another embodiment of the storage apparatus 200 is described below with reference to FIGS. 20-42. In this embodiment, the storage apparatus 200 includes a polygonal support frame 202 having a first support beam 204 defining the longitudinal axis A, a second support beam 206 spaced from the first support beam 204 and extending along the longitudinal axis A, a third support beam 208 extending transverse to the longitudinal axis A, and a fourth support beam 210 spaced from the third support beam 208 and extending transverse to the longitudinal axis A. The first 204 and second 206 support beams are adjustable along the longitudinal axis A between the first length $L_1$ and the second length $L_2$.

The first 204 and second 206 support beams are the same as the support beams 104, 106 of the storage apparatus 100 described in detail above. For example, the first 204 and second 206 support beams has first 220 and second 222 predefined mounting locations along the first support beam 204. The first mounting location 220 defines an extended position of the first support beam 204 having the first length $L_1$ and the second mounting location 222 defines an adjusted position of the first support beam 204 having the second length $L_2$. The second support beam 206 has third 224 and fourth 226 predefined mounting locations along the second support beam 206. The third mounting location 224 defines an extended position of the second support beam 206 having the first length $L_1$ and the fourth mounting location 226 defines an adjusted position of the second support beam 106 having the second length $L_2$.

The apparatus 200 further comprises at least one fastener 228 disposed through the first support beam 204 at the first mounting location 220 when the first support beam 204 is in the extended position, and at least one fastener 228 disposed through the first support beam 204 at the second mounting location 222 when the first support beam 204 is in the adjusted position. Further, at least one fastener 228 is disposed through the second support beam 206 at the third mounting location 224 when the second support beam 206 is in the extended position, and at least one fastener 228 is disposed through the second support beam 206 at the fourth mounting location 226 when the second support beam 206 is in the adjusted position. In an embodiment, the first support beam 204 may define apertures 230 at the first mounting location 220 for receiving the fasteners 228 when the first support beam 204 is in the extended position, and the second support beam 206 may define apertures 232 at the third mounting location 224 for receiving the fasteners 228 when the second support beam 206 is in the extended position. In an embodiment, fasteners 228 are disposed only through the first 204 and second 106 support beams at the first 220 and third 224 mounting locations when the first 204 and second 206 support beams are in the extended position. Further, the first support beam 204 may define apertures 234 at the second mounting location 222 for receiving the fasteners 228 when the first support beam 204 is in the adjusted position, and the second support beam 206 may define apertures 236 at the fourth mounting location 226 for receiving the fasteners 228 when the second support beam 206 is in the adjusted position. In an embodiment, fasteners 228 are disposed only through the first 204 and second 206 support beams at the second 222 and fourth 126 mounting locations when the first 204 and second 206 support beams are in the adjusted position.

Each of the first 204 and second 206 support beams may further comprise a plurality of first 225 and second 227 slots, respectively. The first slots 225 are defined by the first support beam 204 at predetermined positions along the first support beam 204. The second slots 227 are defined by the second support beam 206 at predetermined positions along the second support beam 206. The first 225 and second 227 slots are configured to receive first 244 and second 246 tabs coupled to first 240 and second 242 ends of cross beams 238, as described in further detail below. In an example, the first 225 and second 227 slots defined in the first 204 and second 206 support beams are spaced substantially equally along the first 204 and second 206 support beams. In another example, the first 225 and second 227 slots are positioned along the first 204 and second 206 support beams such that the distance between adjacent slots 225, 227 vary along the first 204 and second 206 support beams. Further each of the first 225 and second 227 slots are sized and shaped to receive the first 240 and second 242 tabs. Further, the slots 225, 227 may be rectangular, square-shaped, circular, oval, etc. In an embodiment, and as shown, each of the slots 225, 227 extend through the support beams 204, 206.

As shown, each of the first 204 and second 206 support beams has first 215, 219 and second 217, 221 support beam pieces with the first piece 215, 219 defining first and second sets of apertures. The first set of apertures is located at the first mounting location 220 and the second set of apertures is located at the second mounting location 222. Further, the second piece 217 defines a third set of apertures. The third set of apertures align with the first set of apertures when the first 204 and second 206 support beams are in the extended position, and the third set of apertures align with the second set of apertures when the first 204 and second 206 support beams are in the adjusted position. In an embodiment, each of the first 215, 219 and second 217, 221 support beam pieces has inner and outer surfaces and a third surface extending substantially perpendicularly to each of the inner and outer surfaces. The third surface of the first piece 215, 219 defines at least one aperture located at the first mounting location 220, 224 and at least one aperture located at the second mounting location 222, 226. The third surface of the second piece 219, 221 defines at least one aperture aligning with the aperture of the third surface of the first piece 215, 219 at the first mounting location 220, 224 when the support beams 204, 206 are in the extended position and align with the aperture of the third surface of the first piece 215, 219 at the second mounting location 222, 226 when the support beams 204, 206 are in the adjusted position.

In the present embodiment, the third 208 and fourth 210 support beams are adjustable between a first width $W_1$ and a second width $W_1$. For example, the third support beam 208 has first 280 and second 282 support beam pieces and the fourth support beam 210 has first 284 and second 286 support beam pieces. The first support beam piece 280, 284 of the third 208 and fourth 210 support beams is slidable relative to the second support beam piece 282, 286 for adjusting the support beams 208, 210. For example, the first 280 and second 282 pieces of the third support beam 208 may telescope such that the first 280 and/or second 282 pieces move relative to the other piece 280, 282, and the first 284 and second 284 pieces of the fourth support beam 210 may telescope such that the first 284 and/or second 286 pieces move relative to the other piece 284, 286.

The third support beam 208 further has first 288 and second 290 predefined mounting locations along the third support beam 208, and the fourth support beam 210 has third 292 and fourth 294 predefined mounting locations along the fourth support beam 210. The first mounting location 288 defines an extended position of the third support beam 208 having the first width $W_1$ and the second mounting location 290 defines an adjusted position of the third support beam 208 having the second width $W_2$. The third mounting location 292 defines an extended position of the fourth support beam 210 having the first width $W_1$ and the fourth mounting location 294 defines an adjusted position of the fourth support beam 210 having the second width $L_2$.

At least one of the fasteners 228 may be disposed through the third support beam 208 at the first mounting location 288 when the third support beam 208 is in the extended position, and at least one of the fasteners 228 may be disposed through the third support beam 208 at the second mounting location 290 when the third support beam 208 is in the adjusted position. Further, at least one of the fasteners 228 may be disposed through the fourth support beam 210 at the third mounting location 292 when the fourth support beam 210 is in the extended position, and at least one of the fasteners 228 may be disposed through the fourth support beam 210 at the fourth mounting location 294 when the fourth support beam 210 is in the adjusted position. In an embodiment, the third support beam 208 may define apertures 296 at the first mounting location 288 for receiving the fasteners 228 when the third support beam 208 is in the extended position, and the fourth support beam 210 may define apertures 298 at the third mounting location 292 for receiving the fasteners 228 when the fourth support beam 210 is in the extended position. In an embodiment, fasteners 228 are disposed only through the third 208 and fourth 210 support beams at the first 288 and third 292 mounting locations when the third 208 and fourth 210 support beams are in the extended position. Further, the third support beam 206 may define apertures 300 at the second mounting location 290 for receiving the fasteners 228 when the third support beam 208 is in the adjusted position, and the fourth support beam 210 may define apertures 302 at the fourth mounting location 294 for receiving the fasteners 228 when the fourth support beam 210 is in the adjusted position. In an embodiment, fasteners 228 are disposed only through the third 208 and fourth 210 support beams at the second 290 and fourth 294 mounting locations when the third 208 and fourth 210 support beams are in the adjusted position.

The storage apparatus 200 further comprises a plurality of cross beams 238 which may be formed from any suitable material, such as a metal, metal alloy, a polymer, and/or combinations thereof. Each cross beam 238 is coupled to at least one of the support beams 204, 206, 208, 210. In an embodiment, and as shown, each cross beam 238 is coupled to the first support beam 204 and the second support beam 206. In an embodiment, each cross beam 238 is substantially perpendicular to both the first support beam 204 and the second support beam 206. Alternatively, one or more of the cross beams 238 may be coupled to the first 204 and second 206 support beams and may extend from each of the support beams 204, 206 at an angle other than a right angle.

In an embodiment, each of the cross beams 238 has first 304 and second 306 cross beam pieces with the first cross beam piece 304 being slidable relative to the second cross beam piece 306 for adjusting the cross beam 238 transverse to the longitudinal axis A between the first width $W_1$ and the second width $W_2$. Each of the first cross beam pieces 304 has a first cross-sectional configuration and each of the second cross beam pieces 306 has a second cross-sectional configuration with each of the second cross beam pieces 306 slidably fitting over a corresponding first cross beam piece 304. In an example, each of the cross beams 238 has cross beam ends 240, 242, and the cross beams 238 have a cross beam configuration extending between the ends 240, 242 and both of the cross beam ends 240, 242 have an end configuration different from the cross beam configuration. In an example, and as shown, each of the first cross beam pieces 304 has a first base 308 with first 310 and second 312 walls extending from the first base 308 at an obtuse angle relative to the first base 308, and each of the second cross beam pieces 306 has a second base 314 with first 316 and second 318 walls extending from the second base 314 at an acute angle relative to the second base 314. In this example, each of the second cross beam pieces 306 slidably fits over a corresponding first cross beam piece 304.

Each of the cross beams 238 may have any cross beam configuration, such as a rectangular configuration, a circular configuration (similar to a rod), a triangular configuration, a hexagonal configuration, etc. Further, one or more pieces of the cross beams 238 may be hollow or solid. In an embodiment, each cross beam 238 has the cross beam ends 240, 242 with a different configuration than the cross beams 238. Further, each of the cross beam ends 240, 242 has a first tab 244 coupled to the first cross beam end 240 and a second tab 246 coupled to the second cross beam end 242. In an example, the first tab 244 extends transverse from the first cross beam end 240 and the second tab 246 extends transverse to the second cross beam end 242. Further, and in an example, the first tab 244 extends at a right angle from a terminal end 243 of the first cross beam end 240 and the second tab 246 extends at a right angle from a terminal end 245 of the second cross beam end 242. The first tab 244 of each of the cross beams 238 is insertable into a respective one of the first slots 225 defined at predetermined positions along the first support beam 204. Further, the second tab 244 of each of the cross beams 238 is insertable into a respective one of the second slots 227 defined at predetermined positions along the second support beam 206.

In an embodiment, the apparatus 200 further includes a fifth support beam 248 extending transverse to the longitudinal axis A. As shown, the fifth support beam 248 is positioned at substantially the center point of the length $L_1$ of the first 204 and second 206 support beams when in the extended position. The fifth support beam 248 may otherwise be positioned in any desirable location along the length $L_1$. In an example, the fifth support beam 248 is coupled to the first 204 and second 206 support beams with at least one fastener 228. For example, the fifth support beam 248 may have first 250 and second 252 ends and aperture(s) 254 defined in each of the ends 250, 252. Further, the first 204 and second 206 support beams may include additional aperture(s) which are aligned with the aperture(s) 254 of the fifth support beam 248, and the fastener(s) 228 may be disposed through the aligned apertures 254 to couple the fifth support beam 248 to the first 204 and second 206 support beams.

In an example, the fifth support beam 248 is adjustable between the first width $W_1$ and the second width $W_2$. For instance, the fifth support beam 248 may have first 318 and second 320 pieces with the first piece 318 being slidable relative to the second piece 320 for adjusting the fifth support beam 248 transverse to the longitudinal axis A between the first width $W_1$ and the second width $W_2$. Each of the first pieces 318 has a first cross-sectional configuration and each of the second pieces 320 has a second cross-sectional configuration with each of the second pieces 320 slidably fitting over a corresponding first piece 318. As shown, each of the first pieces 318 and second pieces 320 have a base 322 with first 324 and second 326 walls extending substantially perpendicularly from the base 322. In this example, each of the second pieces 320 slidably fits over a corresponding first piece 318.

The storage apparatus 200 further includes a plurality of racks 258 each supported on at least a portion of the support beams 204, 206, 208, 210 with the plurality of racks 258 defining a first series 328 of racks 258 aligned transverse to the longitudinal axis A and a second series 330 of racks 258 aligned along the longitudinal axis A. The first series 328 is removable during adjustment of the first 204 and second 206 support beams along the longitudinal axis A, and the second series 330 is removable during the adjustment of the third 208 and fourth 210 (and fifth 248) support beams transverse to the longitudinal axis A. In an example, the first series 328 of racks 258 includes at least two racks 258 when the apparatus 200 is in the extended position. In another example, the first series 328 of racks 258 includes three racks 258 when the apparatus 200 is in the extended position. It is to be understood that the first series 328 of racks 258 may include more than three racks 258, such as four racks 258, five racks 258, etc., when the apparatus 200 is in the extended position. In instances where the first series 328 has three or more racks 258, the first series 328 has exterior racks 332 and interior racks 334 disposed between the exterior racks 332. In an example, at least one of the interior racks 334 is removable during adjustment of the third 208 and fourth 210 support beams. Further, all of the racks 258 in the first series 328 are aligned transverse to the longitudinal axis A.

The first series 328 of racks 258 may be further defined as a plurality of first series 328 of racks 258 with each of the first series 328 of racks 258 having a predefined number of racks 258 aligned transverse to the longitudinal axis A. For example, the storage apparatus 200 may include at least two first series 328 of racks 258 with one of the first series 328 being removable for adjusting the storage apparatus 100 along the longitudinal axis A. In another example, and as shown, the storage apparatus 200 includes four first series 328 of racks 258 with each first series 328 having three racks 258. In an example, and as shown, each of the plurality of first series 328 of racks 258 is supported by at least two of the cross beams 238 when the first 204 and second 206 support beams are in the extended position.

In an example, each of the first series 328 of racks 258 has a lip 260 at opposing ends 262, 264 which are configured to wrap around the first 204 and second 206 support beams when the first series 328 of racks 258 are supported by the polygonal support frame 202. Alternatively, each of the first series 328 of racks 258 are positioned on and/or removably coupled to the polygonal support frame 202 such that the racks 258 are not movable during use of the apparatus 200. In an example, the apparatus 200 further includes at least one clip 259 for securing one of the racks 258 to another of the racks 258. The racks 258 secured to one another may be present in the same series, such as adjacent racks in the first series 328 of racks 258 or adjacent racks in the second series 330 of racks 258.

In an example, the second series 330 of racks 258 includes at least two racks 258 when the apparatus 200 is in the extended position. In another example, the second series 330 of racks 258 includes at least three racks 258 when the apparatus 200 is in the extended position. In still another example, the second series 330 of racks 258 includes four racks 258 when the apparatus 200 is in the extended position. It is to be understood that the second series 330 of racks 258 may include more than four racks 258, such as five racks 258, six racks 258, etc., when the apparatus 200 is in the extended position. In instances where the second series 330 has three or more racks 258, the second series 330 has exterior racks 336 and interior racks 338 disposed between the exterior racks 336. In an example, at least one of the interior racks 338 is removable during adjustment of the first 204 and second 206 support beams. Further, all of the racks 258 in the second series 320 are aligned along to the longitudinal axis A.

The second series 330 of racks 258 may be further defined as a plurality of second series 330 of racks 258 with each of the second series 330 having a predefined number of racks 258 aligned along the longitudinal axis A. Typically, the number of racks 258 in the second series 330 is the same as the number of first series 328 of racks 258. For example, when the storage apparatus 200 has four first series 328 of racks 258, each of the second series 330 has four racks 258. In an example, each of the plurality of second series 330 of racks 258 is supported by a plurality of the cross beams 238 when the first 204 and second 206 support beams are in the extended position.

As shown, the first 328 and second 330 series of racks 258 form a grid of racks 258, one of the first series 328 of racks 258 crosses one of the second series 330 of racks 258. With this configuration, one of the racks 258 is common to each of the first 328 and second 330 series of racks 258 (e.g., the rack 258 is present in both the first 328 and second 330 series), while the remaining racks 258 are different (or not common to the first 328 and second 330 series of racks 258). For example, for an apparatus 200 that has a 4×3 grid of racks (i.e., four first series 328 of racks 258 and three second series 330 of racks 258), the rack 258 at the bottom left would be common to both a first one of the first series 328 of racks 258 and a third one of the second series 330 of racks 258.

Each of the racks 258 in the first 328 and second 330 series of racks 258 may be a solid sheet of material, such as a solid sheet of metal, metal alloy, a polymer, and/or combinations thereof. Alternatively, and as shown, each of the rack 258 may be or has a wire mesh. Further, each of the racks 258 may have any suitable shape or configuration. In an example, each of the racks 258 is quadrilaterally shaped. In another example, each of the racks 258 is rectangularly shaped.

In an embodiment, the apparatus 200 further includes a plurality of suspension legs 266 coupled to and extending away from at least two of the support beams 204, 206, 208, 210 for coupling to the surface 10. In an example, the apparatus 200 includes a suspension leg 266 coupled to each of the support beams 204, 206, 208, 210. In another example, the apparatus 200 includes two suspension legs 266 coupled each end of the first support beam 204 and two suspension legs 266 coupled to each end of the second support beam 206. In still another example, the apparatus 200 includes two suspension legs 266 coupled to each end of the third support beam 208 and two suspension legs 266 coupled to each end of the fourth support beam 210. It is to be understood that the apparatus 200 may have as many suspension legs as desired and the suspension legs 266 may be coupled to any two or more of the support beams 204, 206, 208, 210.

Figure 20:
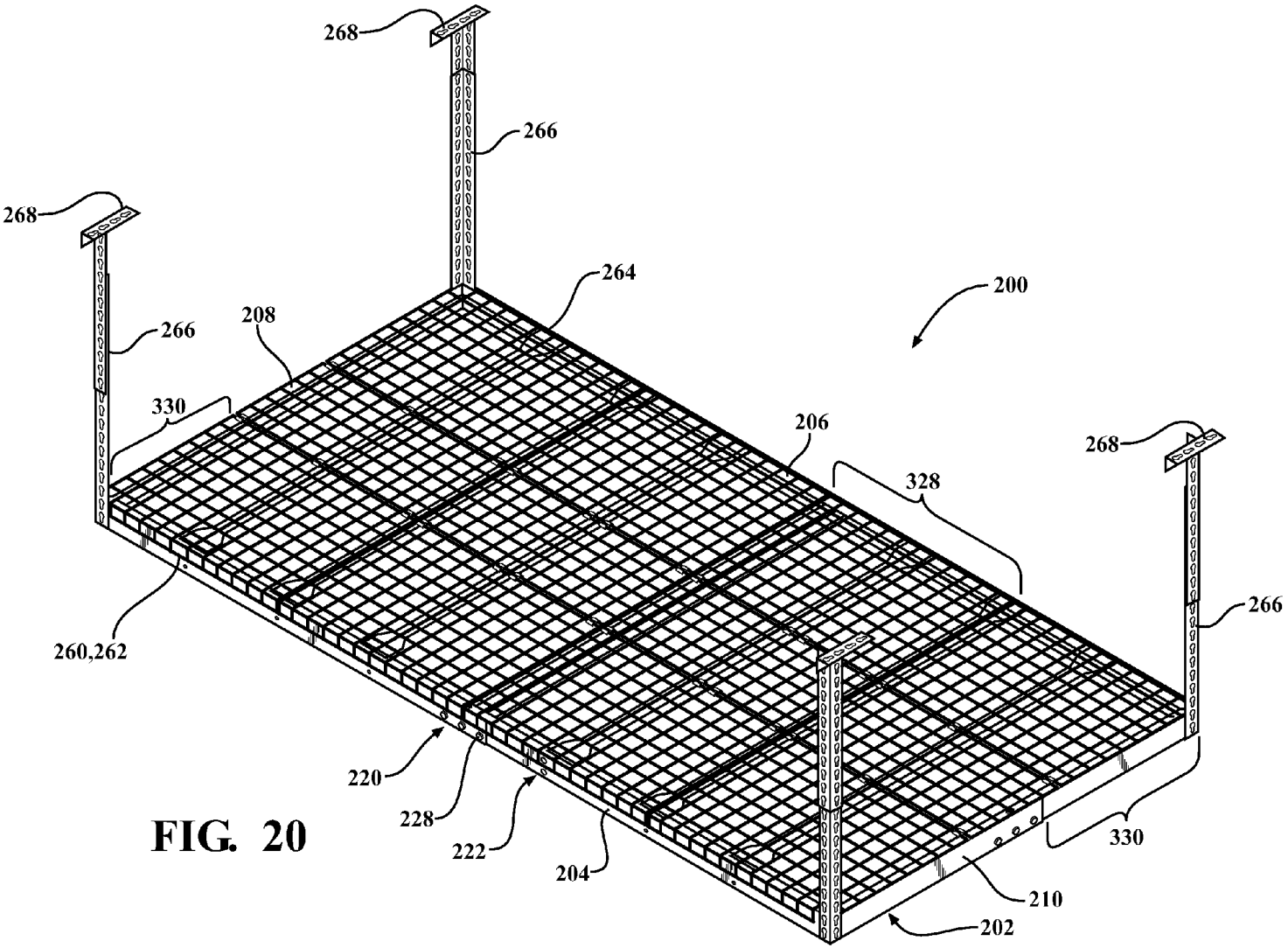
FIG. 20 is a perspective view of another embodiment of the storage apparatus in an extended position.
Figure 21:
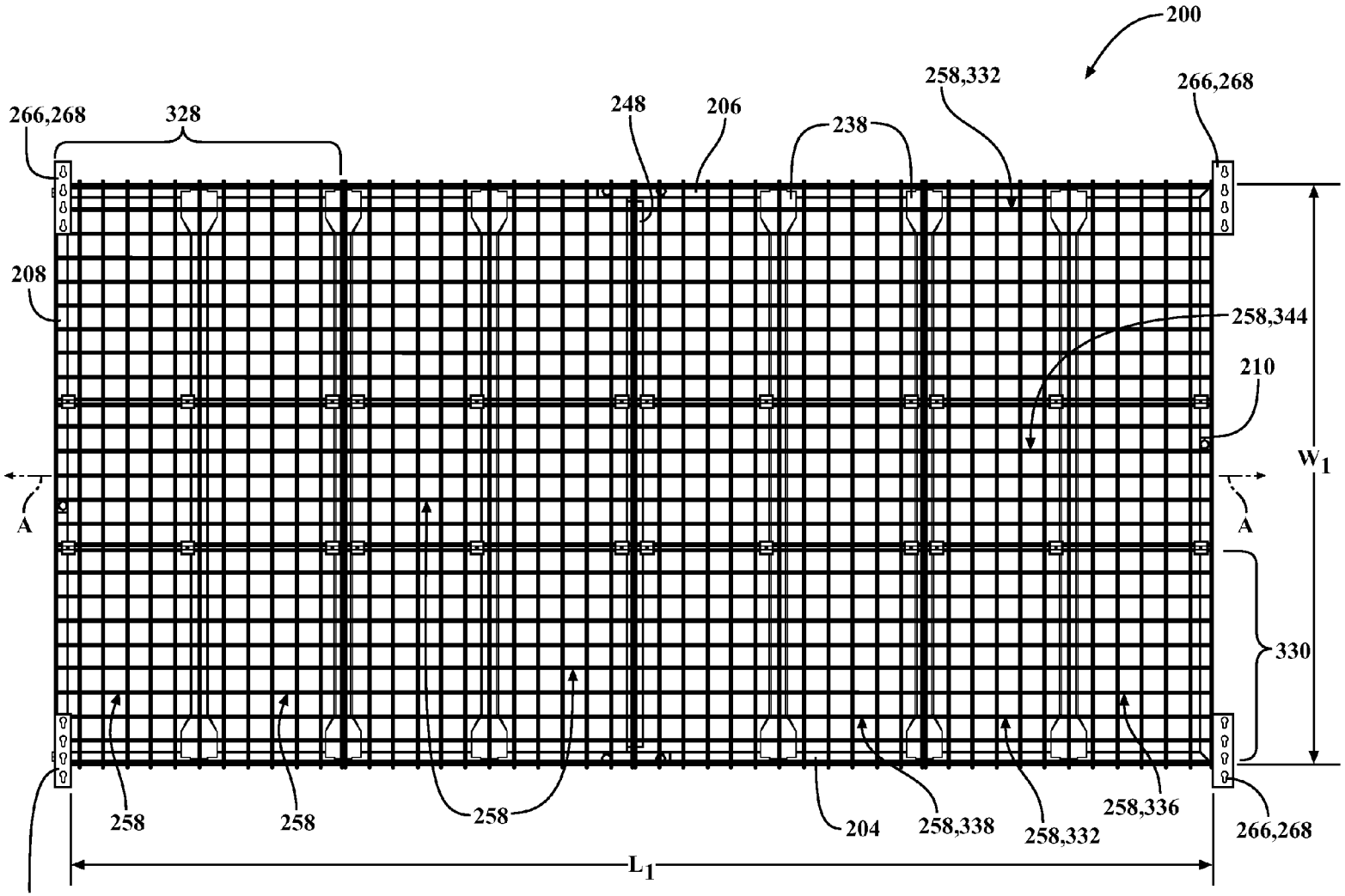
FIG. 21 is a top plan view of the storage apparatus of FIG. 20.
Figure 22:
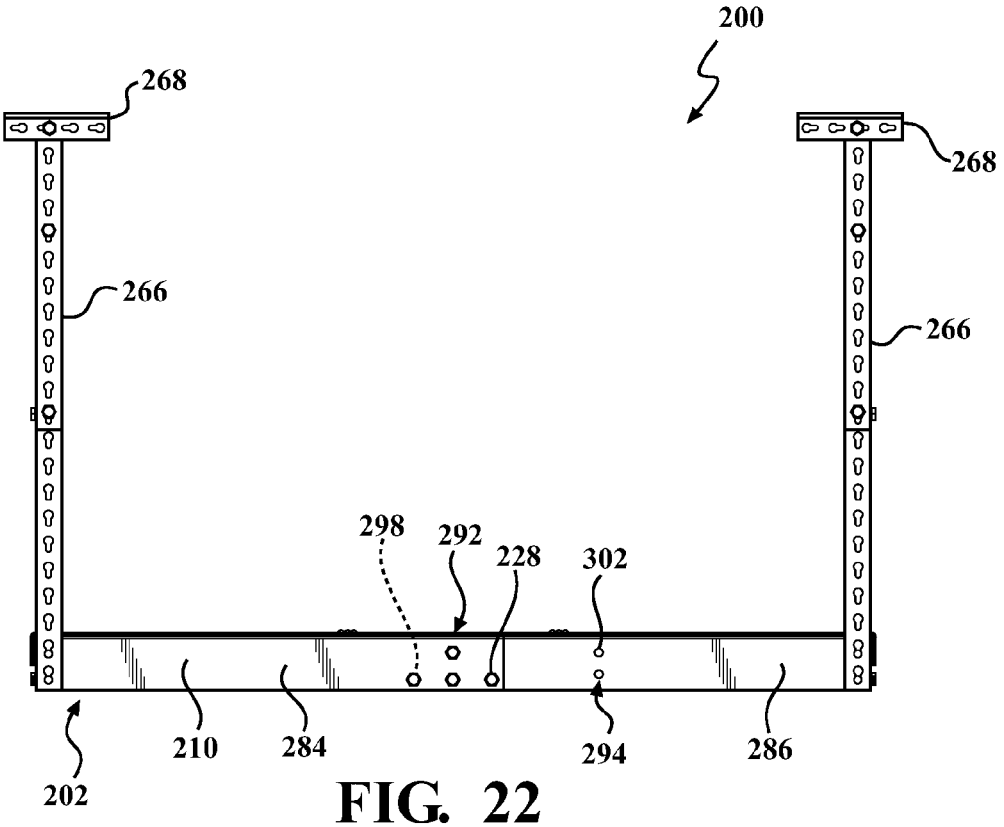
FIG. 22 is a right side view of the storage apparatus of FIG. 20.
Figure 23:
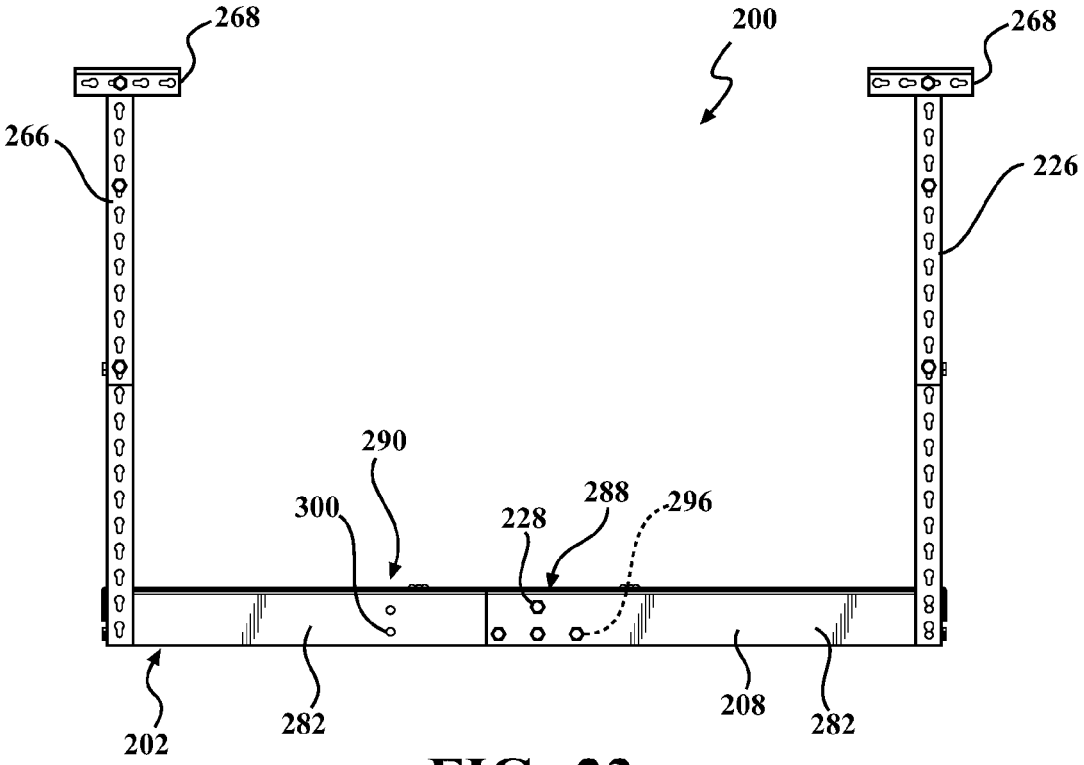
FIG. 23 is a left side view of the storage apparatus of FIG. 20.
Figure 24:
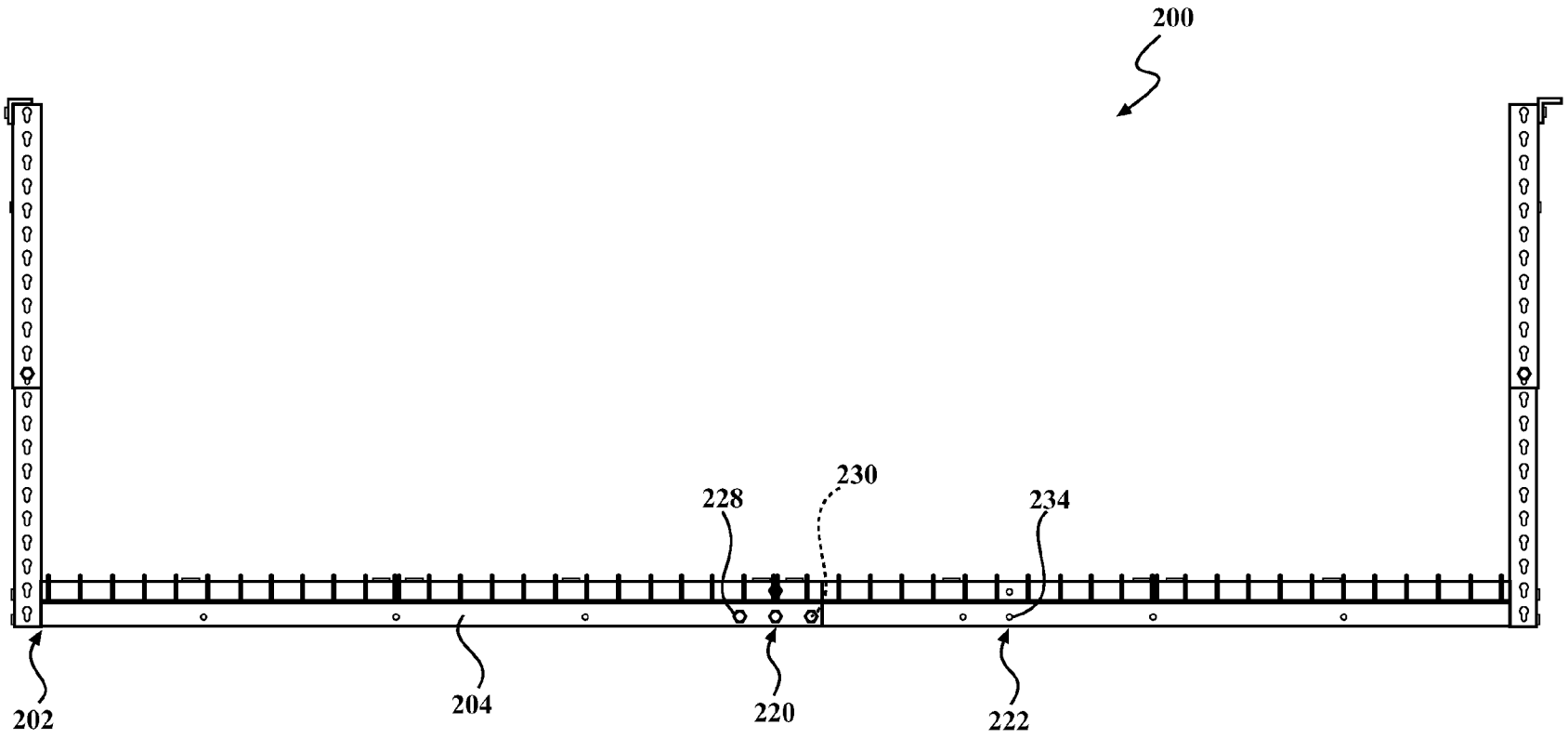
FIG. 24 is a front view of the storage apparatus of FIG. 20.
Figure 25:
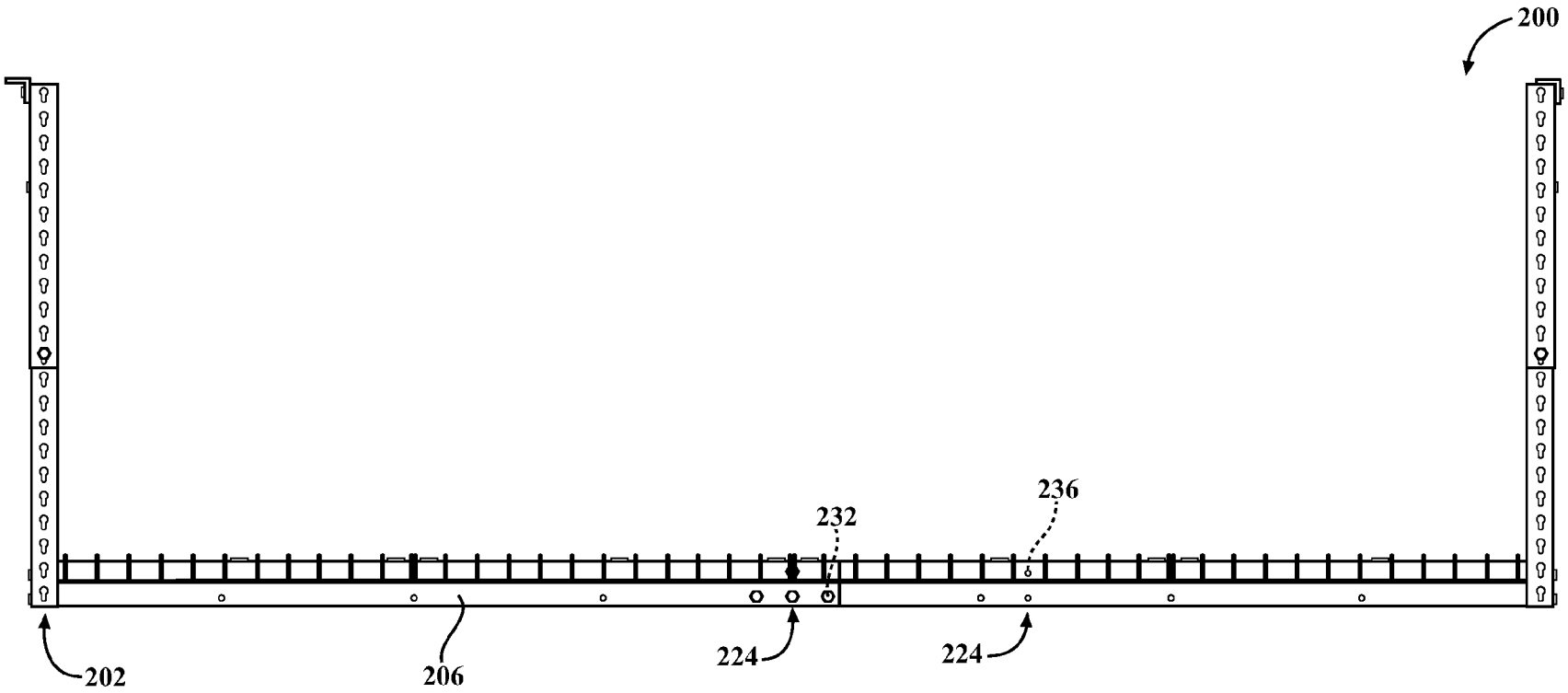
FIG. 25 is a rear view of the storage apparatus of FIG. 20.
Figure 26:
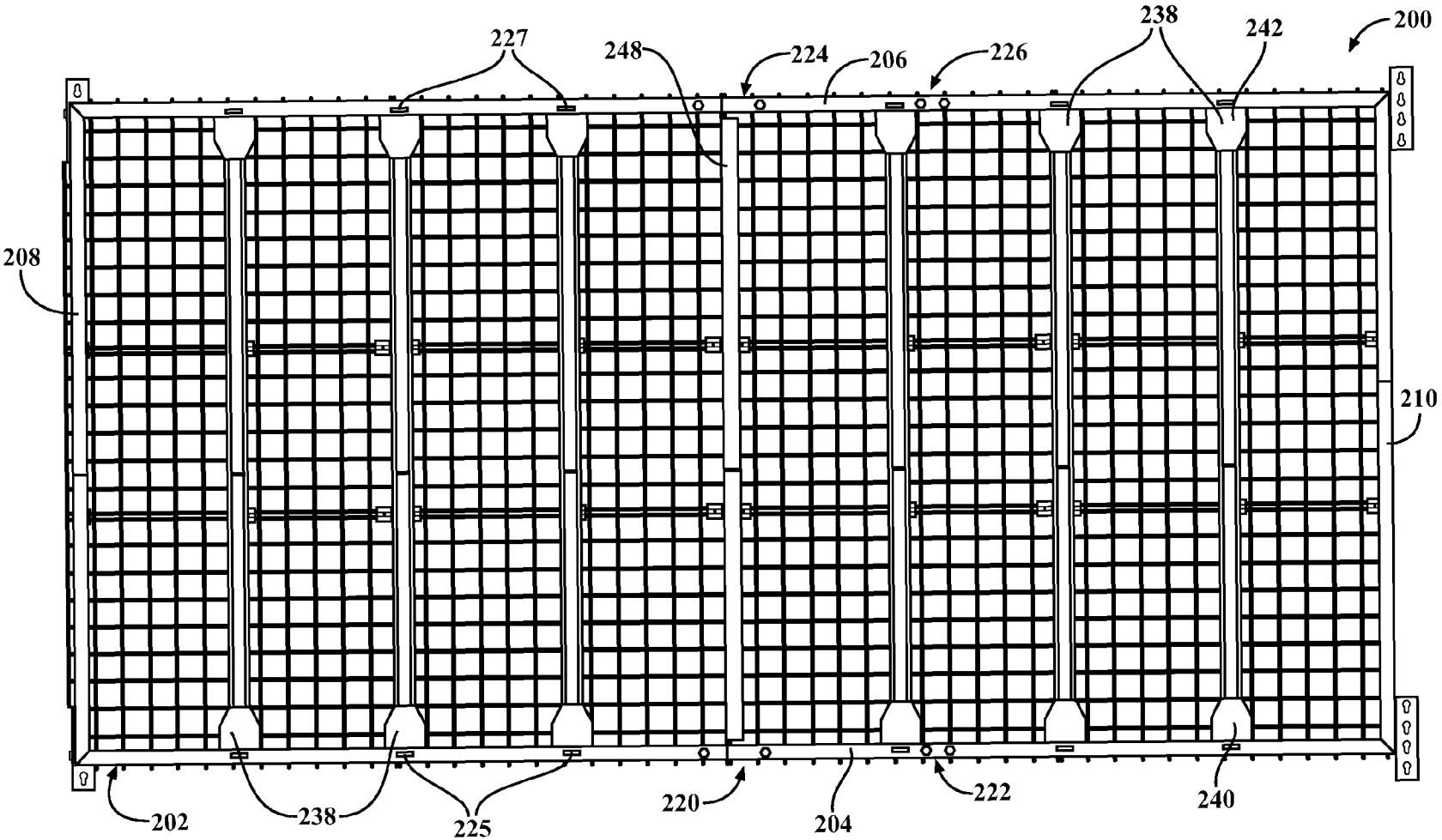
FIG. 26 is a bottom plan view of the storage apparatus of FIG. 20.
Figure 27:
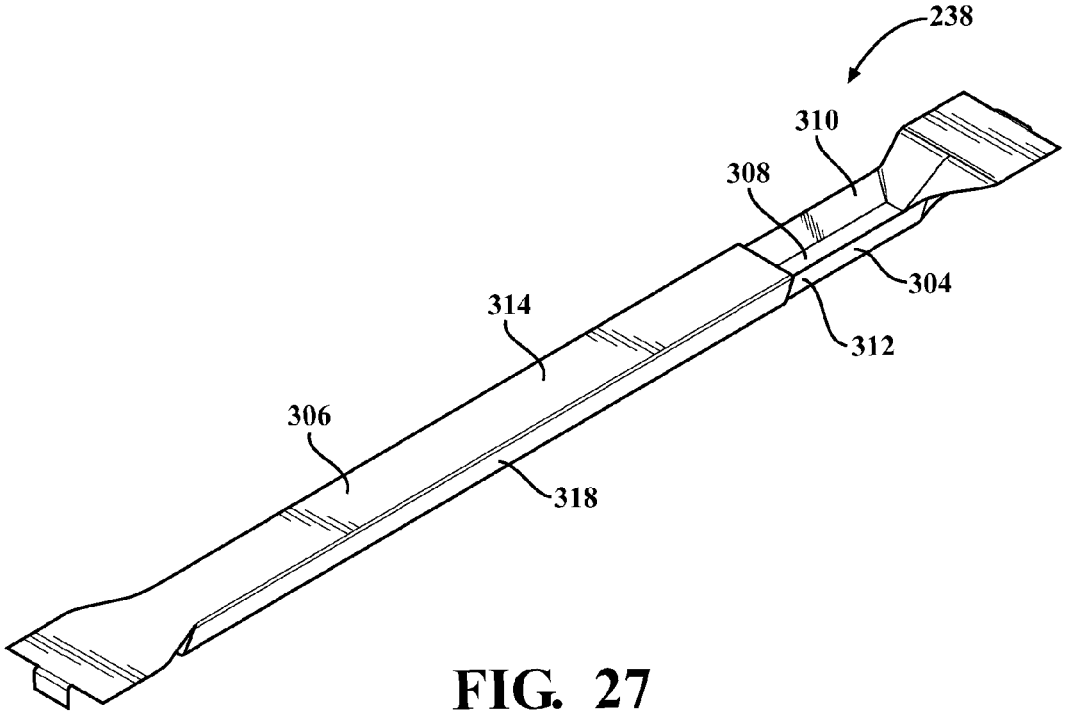
FIG. 27 is a perspective view of a cross beam of the storage apparatus of FIG. 20.
Figure 28:
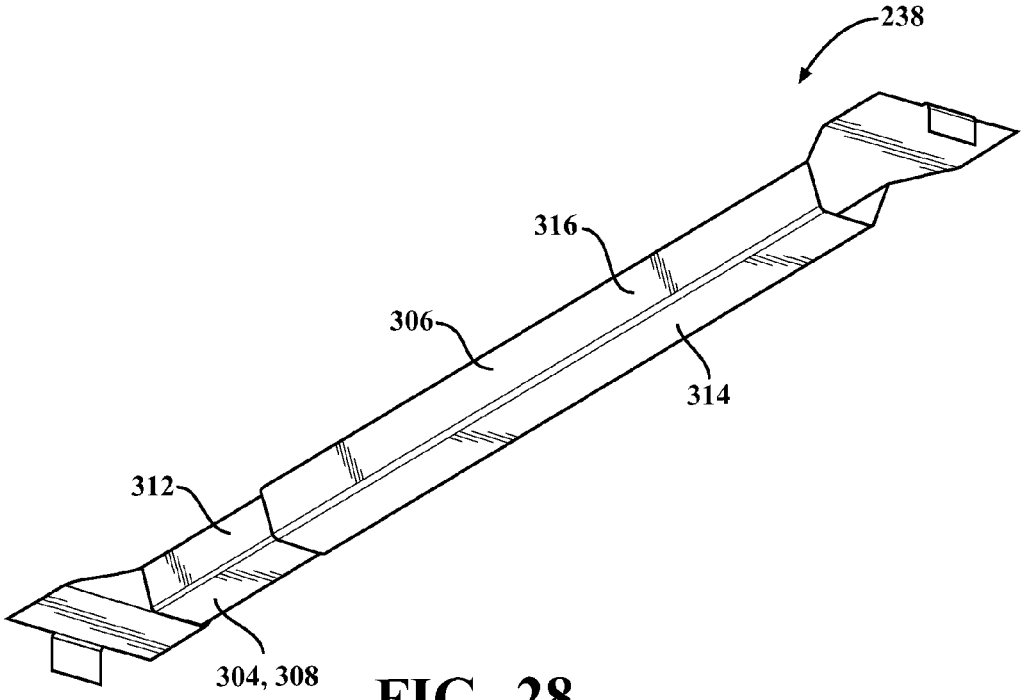
FIG. 28 is another perspective view of a cross beam of the storage apparatus of FIG. 20.
Figure 29:
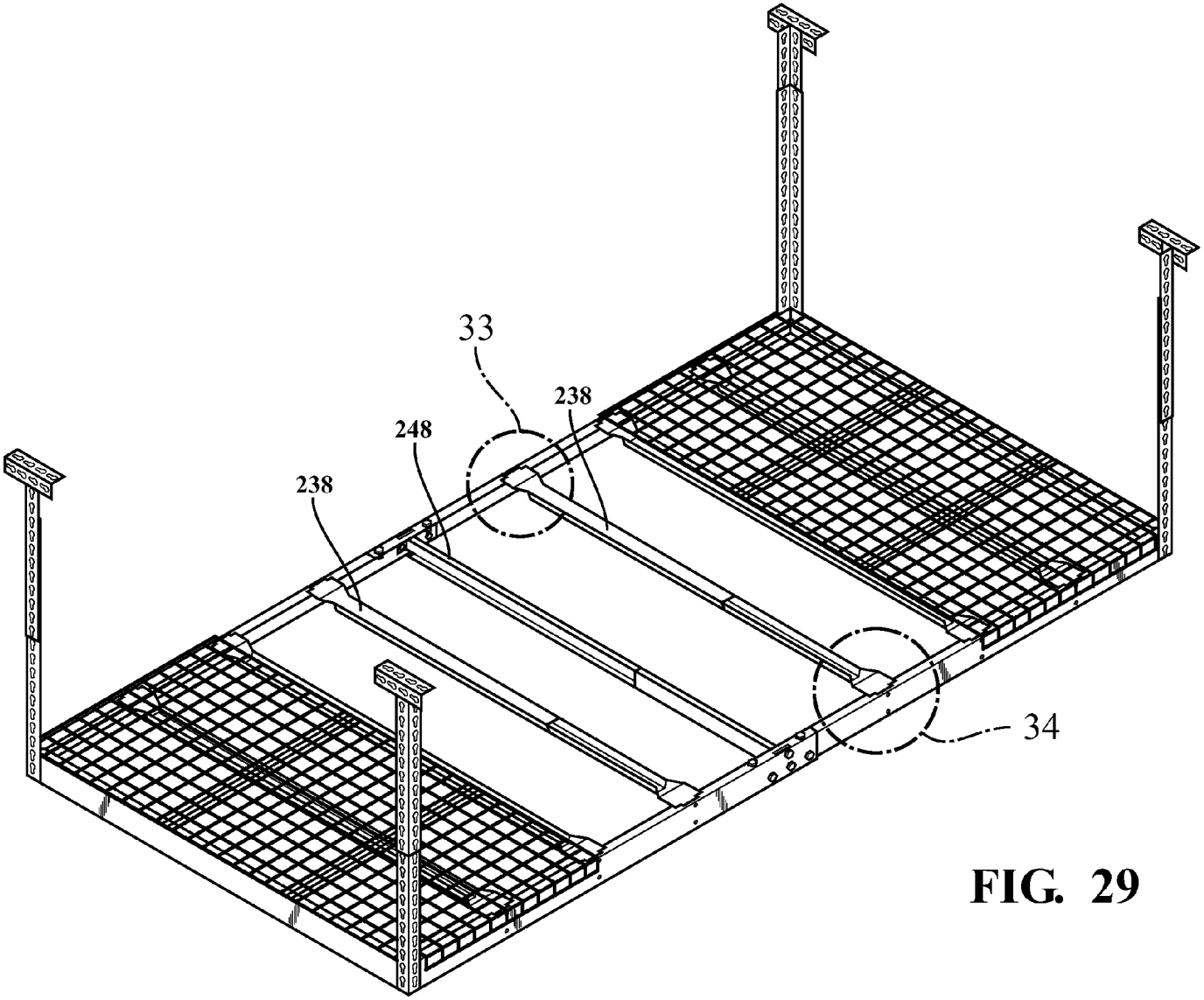
FIG. 29 is a perspective view of the storage apparatus of FIG. 20 with two first series of racks removed to expose a portion of a polygonal support frame, a fifth support beam, and a plurality of cross beams.
Figure 30:
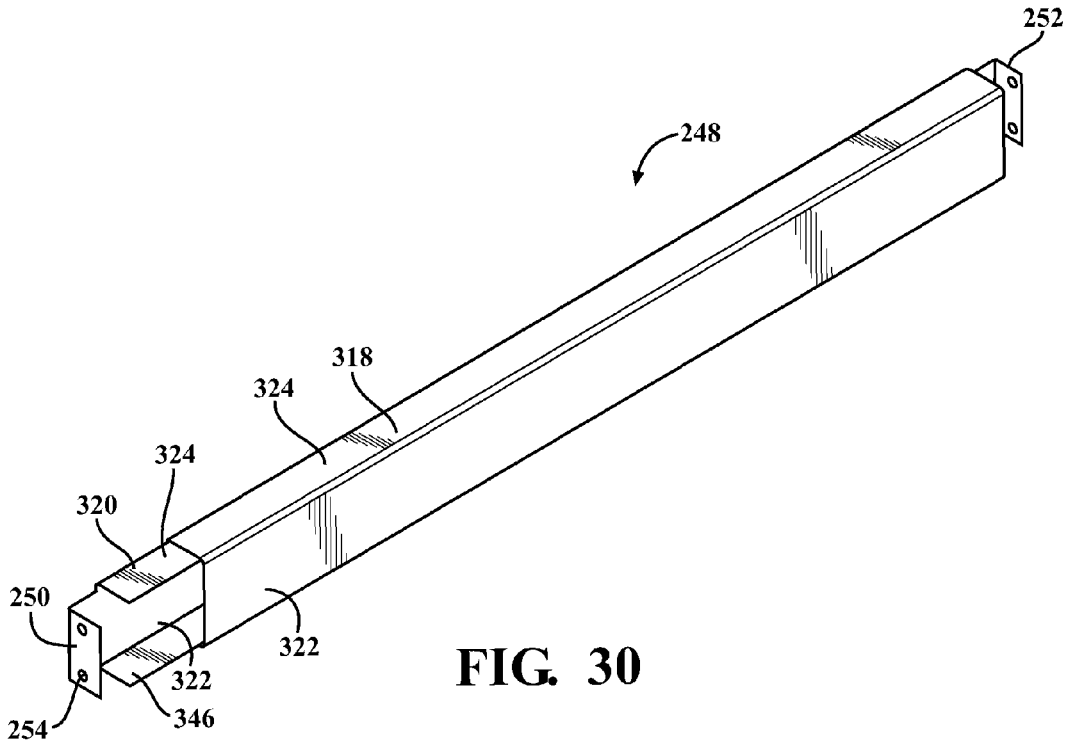
FIG. 30 is a perspective view of the fifth support beam of the storage apparatus of FIG. 20.
Figure 31:
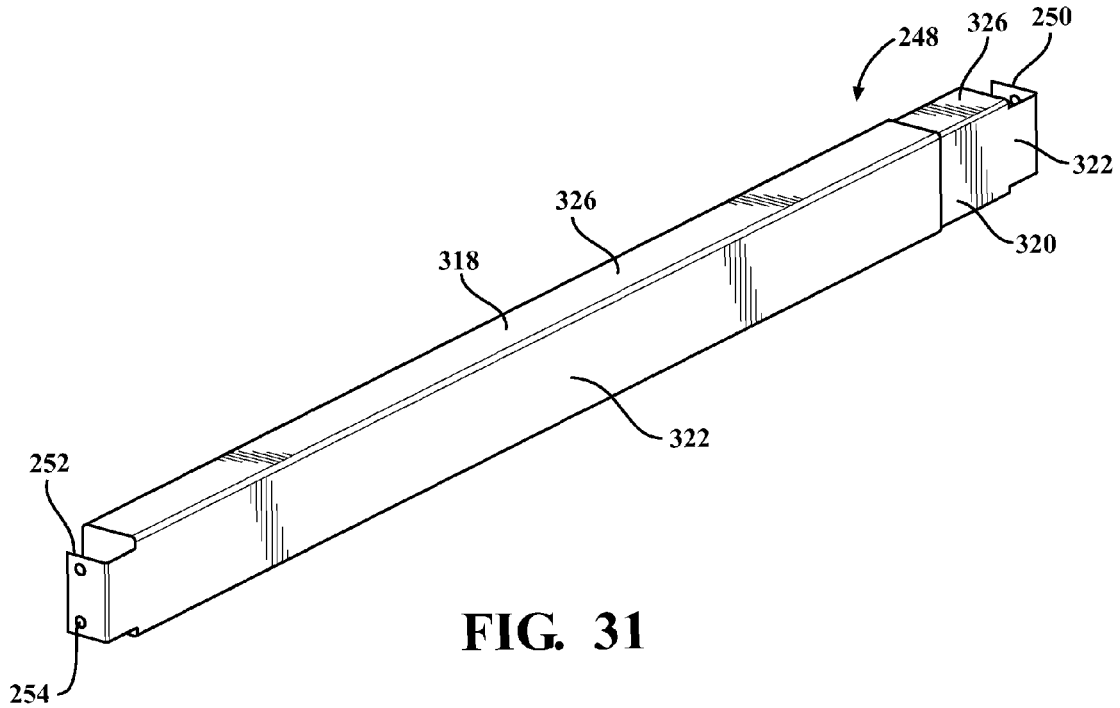
FIG. 31 is another perspective view of the fifth support beam of the storage apparatus of FIG. 20.
Figure 32:
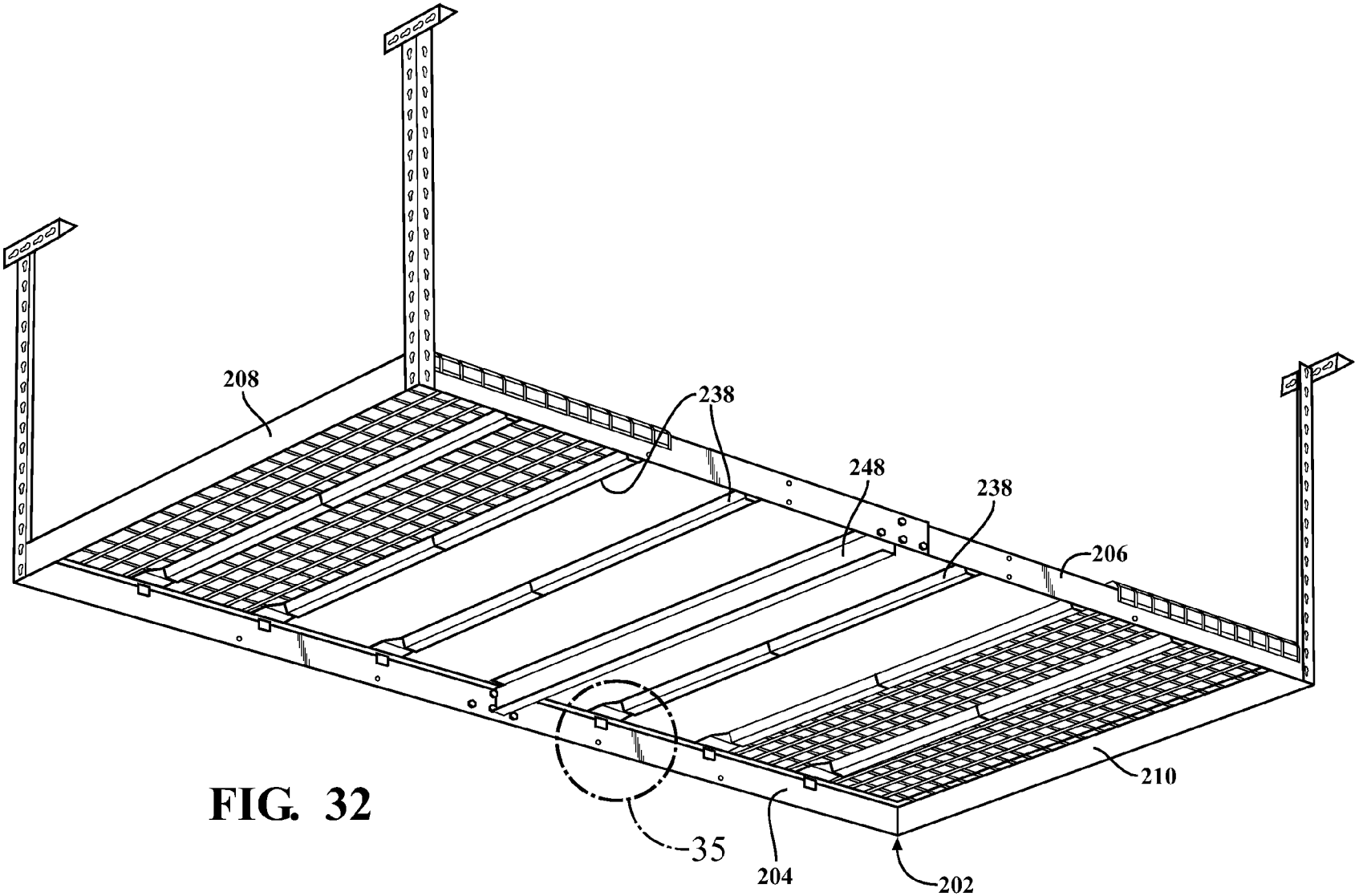
FIG. 32 is another perspective view of the storage apparatus of FIG. 20 with two of the first series of racks removed.
Figure 33:
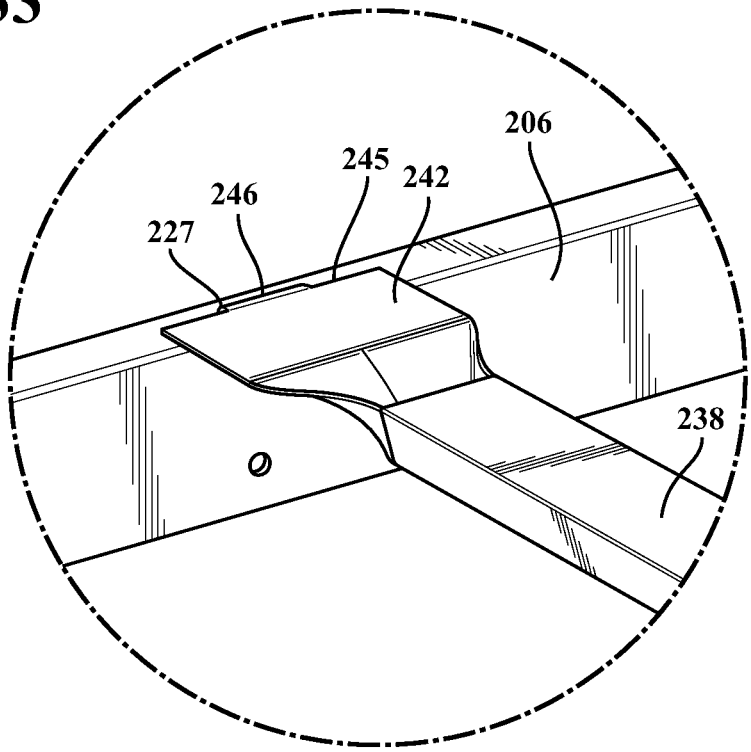
FIG. 33 is an enlarged view of a portion of the storage apparatus of FIG. 29 showing a cross beam coupled to the second support beam.
Figure 34:
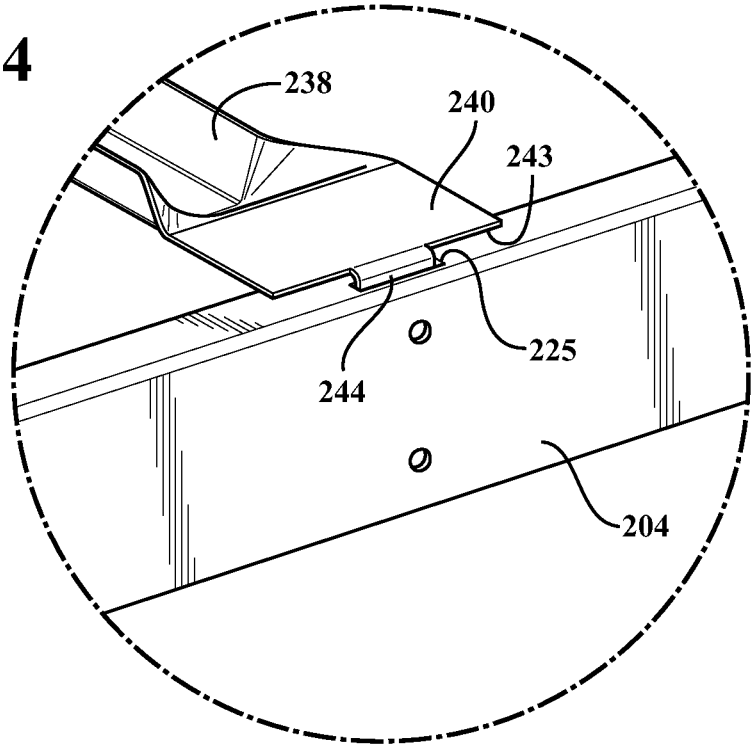
FIG. 34 is an enlarged view of a portion of the storage apparatus of FIG. 29 showing a cross beam coupled to the first support beam.
Figure 35:
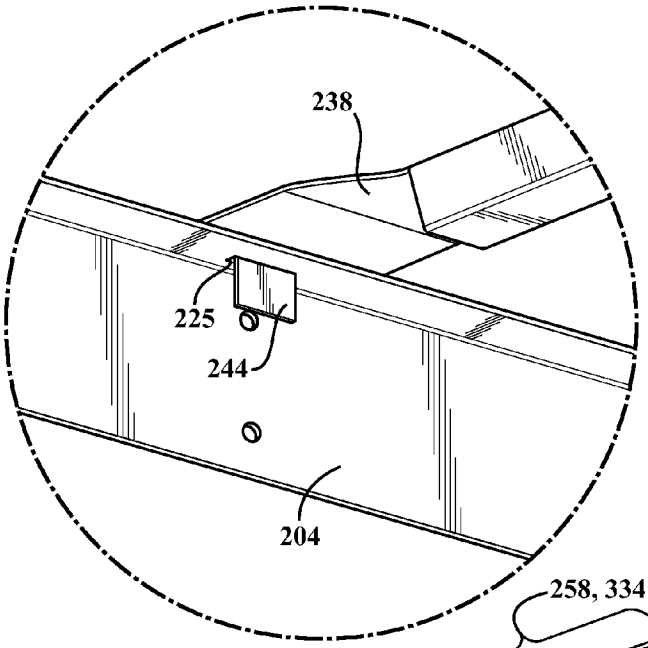
FIG. 35 is an enlarged view of a portion of the storage apparatus of FIG. 32 showing a cross beam coupled to the second support beam.
Figure 36:
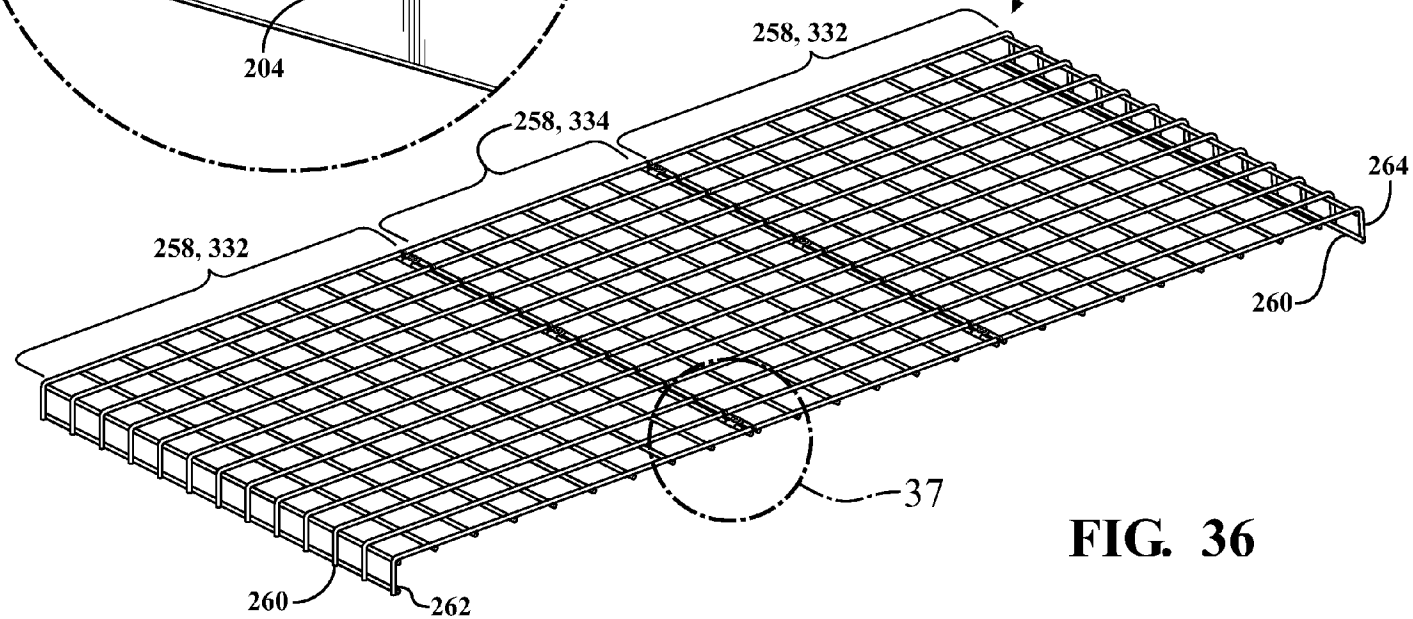
FIG. 36 is a perspective view of an embodiment of a first series of racks for the storage apparatus of FIG. 20.
Figure 37:
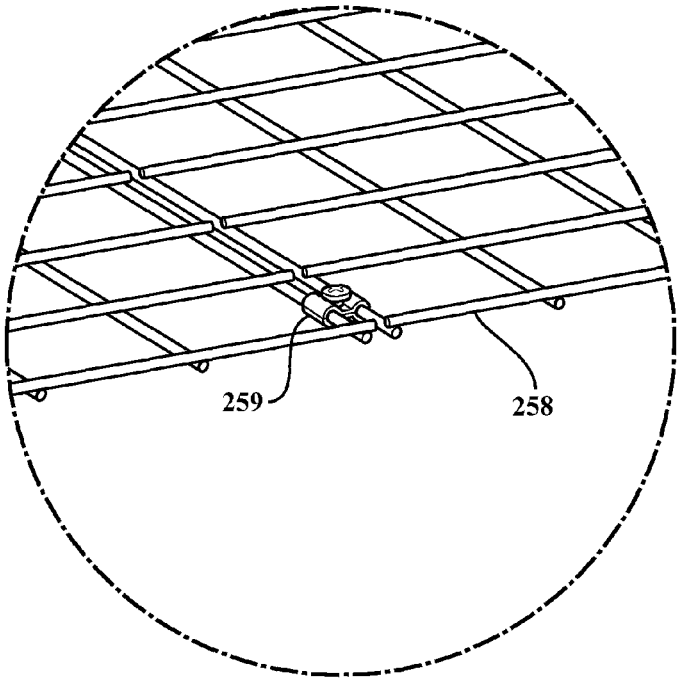
FIG. 37 is an enlarged view of a portion of the first series of racks of FIG. 36 showing a clip for securing adjacent racks.
Figure 38:
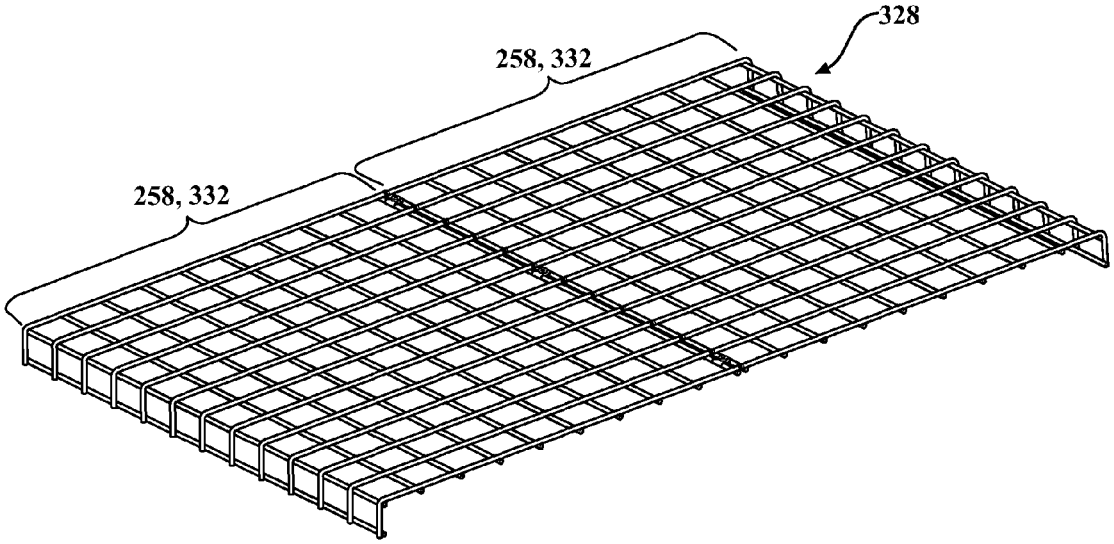
FIG. 38 is a perspective view of an adjusted first series of racks, where an interior rack was removed.
Figure 39:
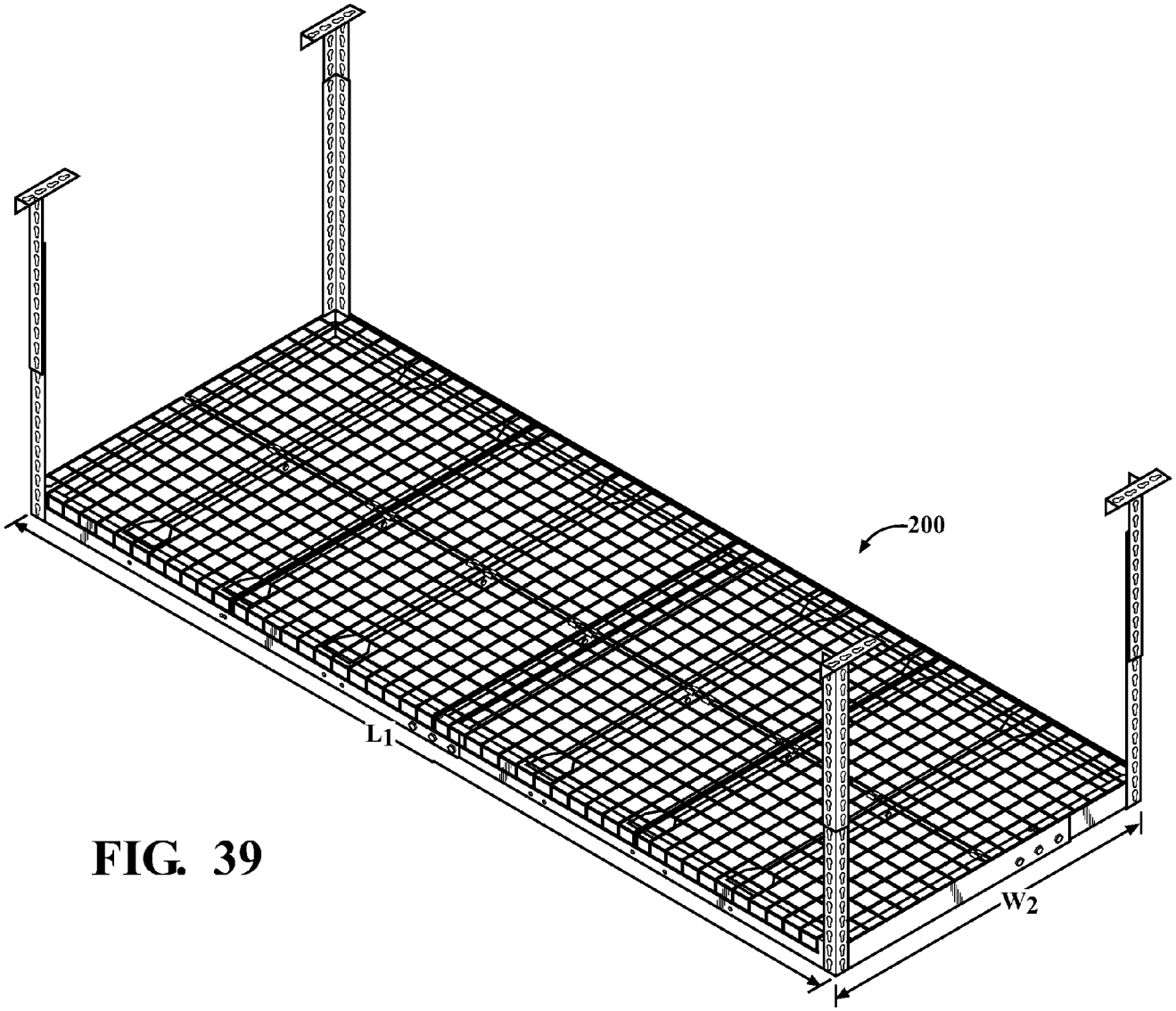
FIG. 39 is a perspective view of the storage apparatus of FIG. 20 with a second series of racks removed and the apparatus shown in an adjusted position relative to its width.
Figure 40:
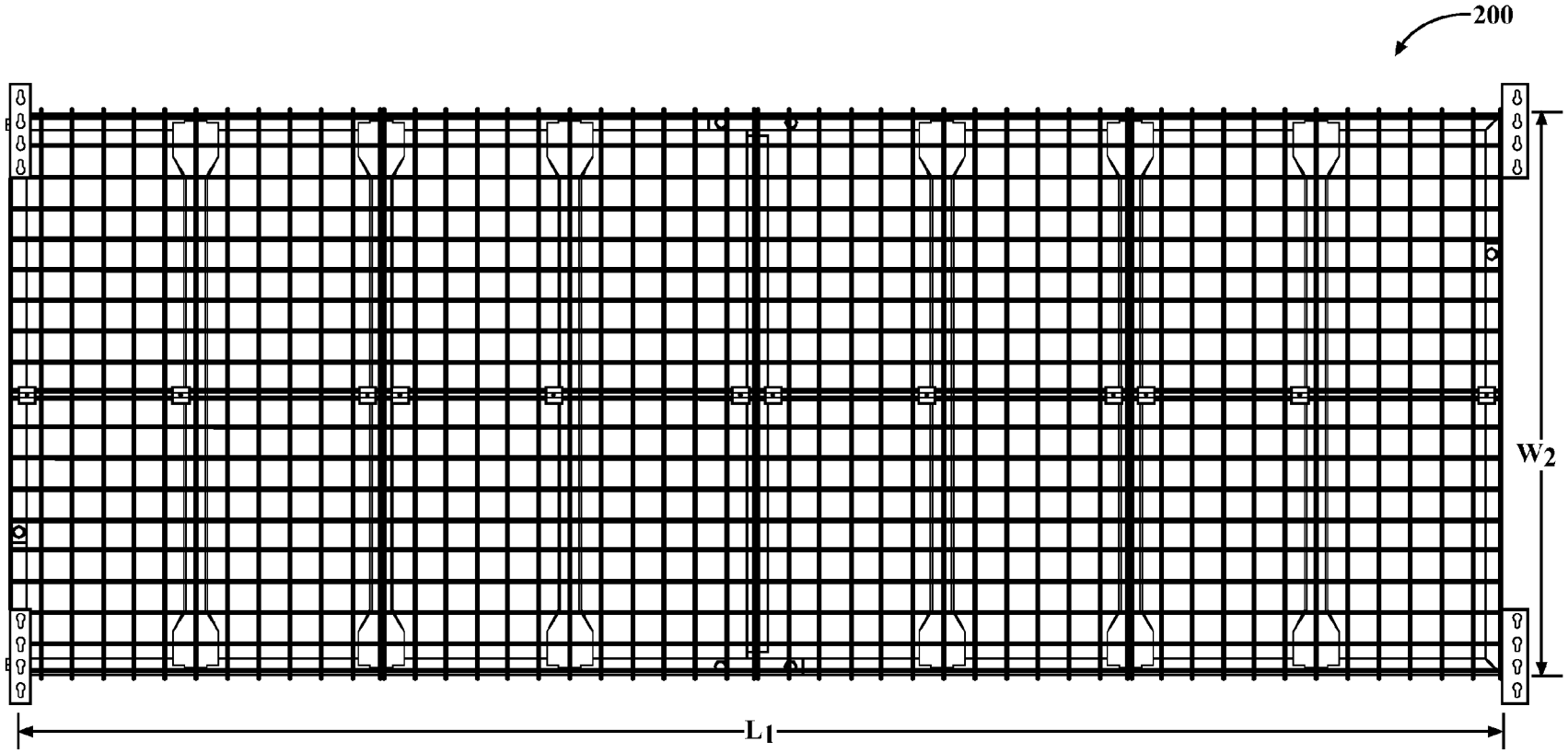
FIG. 40 is a top plan view of the adjusted storage apparatus of FIG. 39.
Figure 41:
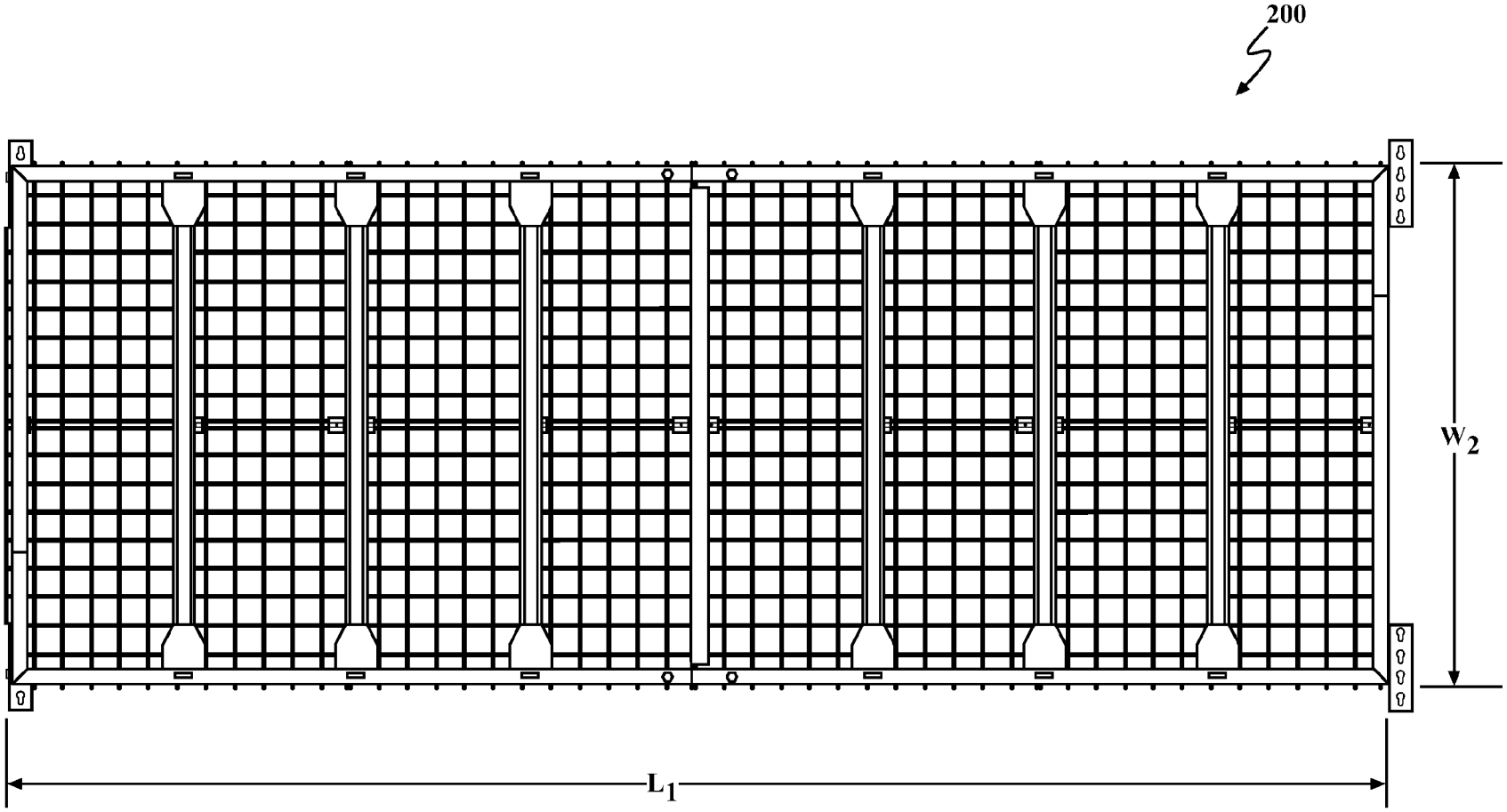
FIG. 41 is a bottom plan view of the adjusted storage apparatus of FIG. 39.

In an example, the apparatus 200 is in the extended position when the apparatus 200 is at its full length (i.e., the support beams 204, 206 have the first length $L_1$). In the extended position, as shown in FIG. 20 for example, the apparatus 200 includes four first series 328 of racks 258 aligned along the longitudinal axis A with each of the first series 328 having three racks 258. The apparatus 200 may be attached to the surface 10 when in the extended position.

In another example, the apparatus 200 is in the adjusted position when the apparatus 200 is at an adjusted length (i.e., the support beams 204, 206 have the second length $L_2$) and/or when the apparatus 200 is at an adjusted width (i.e., the support beams 208, 210 have the second width $W_2$). The adjusted length may be the length of the apparatus 200 when one or more of the first series 328 of racks 258 is removed. The adjusted width may be the width of the apparatus 200 when one or more of the second series 330 of racks 258 is removed. In an example, adjustment of the length of the apparatus 200 may be accomplished by removing at least one of the first series 328 of racks 258, such as one or more of the interior first series 328 of racks 258, removing the fasteners 228 disposed through the first 204 and second 206 support beams at the respective first 220 and third 224 mounting locations, adjusting the first 204 and second 206 support beams, and disposing the fasteners 228 through the beams 204, 206 at the respective second 222 and fourth 226 mounting locations. The apparatus 200 with an adjusted length is shown, for example, in FIG. 42. The adjusted apparatus 200 may then be attached to the surface 10, for example, by attaching the ends 268 of the suspension legs 266 to the surface 10 utilizing fasteners 128.

Figure 42:
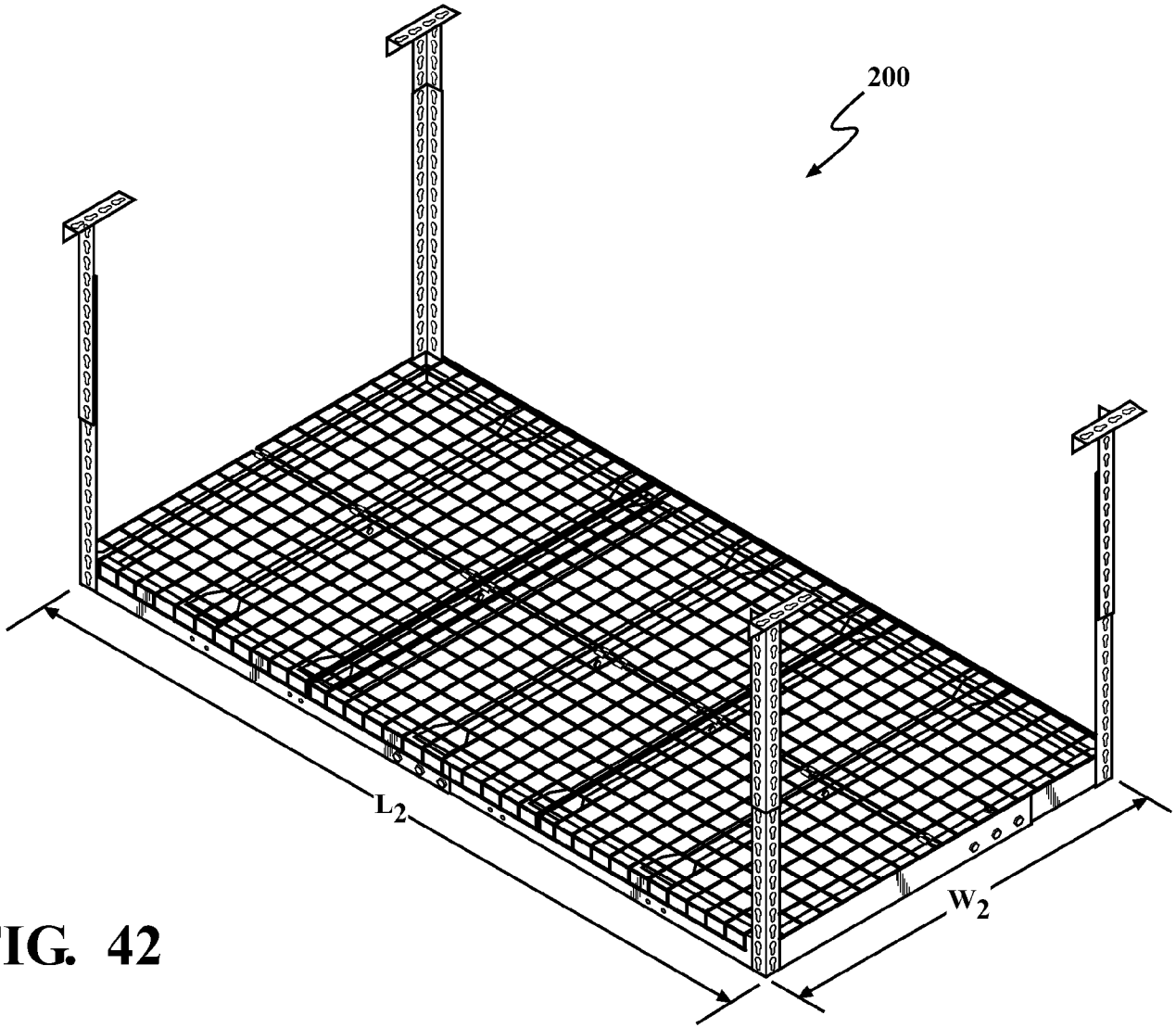
FIG. 42 is a perspective view of the storage apparatus of FIG. 20 with a first series of racks and a second series of racks removed and the apparatus shown in an adjusted position relative to its length and width.

In an example, adjustment of the width of the apparatus 200 may be accomplished by removing at least one of the second series 320 of racks 258, such as one or more of the interior second series 330 of racks 258, removing the fasteners 228 disposed through the third 208 and fourth 210 support beams at the respective first 288 and third 292 mounting locations, adjusting the third 208 and fourth 210 support beams, and disposing the fasteners 228 through the beams 208, 210 at the respective second 300 and fourth 302 mounting locations. The apparatus 200 with an adjusted width is shown, for example, in FIGS. 39-42. It is noted that FIG. 42 shows the apparatus 200 with an adjusted length and an adjusted width. The adjusted apparatus 200 may then be attached to the surface 10, for example, by attaching the ends 268 of the suspension legs 266 to the surface 10 utilizing fasteners 128.

While the invention has been described with reference to the examples above, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all examples falling within the scope of the appended claims.

What is claimed is:

1. A storage apparatus attachable to a surface, said storage apparatus comprising:

a polygonal support frame having:

a first support beam defining a longitudinal axis and being adjustable along said longitudinal axis between a first length and a second length;

a second support beam spaced from said first support beam with said second support beam extending along said longitudinal axis and being adjustable along said longitudinal axis between said first and second lengths;

a third support beam extending transverse to said longitudinal axis and being adjustable between a first width and a second width; and a fourth support beam spaced from said third support beam with said fourth support beam extending transverse to said longitudinal axis and being adjustable between said first and second widths;

a plurality of cross beams each coupled to at least one of said support beams;

a plurality of suspension legs coupled to and extending away from at least two of said support beams for coupling to the surface; and a plurality of racks each supported on at least a portion of said support beams with said plurality of racks defining a first series of racks aligned transverse to said longitudinal axis and a second series of racks aligned along said longitudinal axis with said first series being removable during said adjustment of said first and second support beams along said longitudinal axis, and said second series being removable during said adjustment of said third and fourth support beams transverse to said longitudinal axis.

2. The storage apparatus as set forth in claim 1 wherein said first series of racks is further defined as a plurality of first series of racks with each of said first series having a predefined number of racks aligned transverse to said longitudinal axis and said second series of racks is further defined as a plurality of second series of racks with each of said second series having a predefined number of racks aligned along said longitudinal axis.

3. The storage apparatus as set forth in claim 1 wherein one of said plurality of racks is common to each of said first and second series of racks.

4. The storage apparatus as set forth in claim 1 wherein each of said plurality of racks is quadrilaterally shaped.

5. The storage apparatus as set forth in claim 1 wherein each of said plurality of racks is rectangularly shaped.

6. The storage apparatus as set forth in claim 1 wherein each of said first series of racks has three racks and each of said second series of racks has four racks when each of said first and second support beams are in an extended position.

7. The storage apparatus as set forth in claim 1 wherein each of said first series of racks has exterior and interior racks and at least one of said interior racks is removable during said adjustment of said third and fourth support beams.

8. The storage apparatus as set forth in claim 1 wherein each of said second series of racks has exterior and interior racks and at least one of said interior racks is removable during said adjustment of said first and second support beams.

9. The storage apparatus as set forth in claim 1 wherein said first series of racks is further defined as a plurality of first series of racks and said second series of racks is further defined as a plurality of second series of racks and each of said first series of racks is supported by at least two of said cross beams when said first and second support beams are in an extended position.

10. The storage apparatus as set forth in claim 1 wherein said first series of racks is further defined as a plurality of first series of racks and said second series of racks is further defined as a plurality of second series of racks and each of said second series of racks is supported by a plurality of said cross beams when said first and second support beams are in said extended position.

11. The storage apparatus as set forth in claim 1 further including at least one clip securing one of said racks to another of said racks.

12. The storage apparatus as set forth in claim 1 wherein said first support beam has first and second predefined mounting locations along said first support beam with said first mounting location defining an extended position of said first support beam having said first length and said second mounting location defining an adjusted position of said first support beam having said second length, and said second support beam has third and fourth predefined mounting locations along said second support beam with said third mounting location defining an extended position of said second support beam having said first length and said fourth mounting location defining an adjusted position of said second support beam having said second length.

13. The storage apparatus as set forth in claim 12 further comprising at least one fastener disposed through said first support beam at said first mounting location when said first support beam is in said extended position and disposed through said first support beam at said second mounting location when said first support beam is in said adjusted position, and at least one fastener disposed through said second support beam at said third mounting location when said second support beam is in said extended position and disposed through said second support beam at said fourth mounting location when said second support beam is in said adjusted position.

14. The storage apparatus as set forth in claim 13 wherein each of said first and second support beams has outer and inner surfaces with said surfaces positioned substantially parallel to each other and defining apertures at said first and third mounting locations for receiving said fasteners when said first and second support beams are in said extended position and said surfaces defining apertures at said second and fourth mounting locations for receiving said fasteners when said first and second support beams are in said adjusted position.

15. The storage apparatus as set forth in claim 1 wherein each of said cross beams has first and second cross beam pieces with said first cross beam piece being slidable relative to said second cross beam piece for adjusting said cross beam transverse to said longitudinal axis between said first and second widths.

16. The storage apparatus as set forth in claim 15 wherein each of said first cross beam pieces has a first cross-sectional configuration and each of said second cross beam pieces has a second cross-sectional configuration with each of second cross beam pieces slidably fitting a corresponding first cross beam piece.

17. The storage apparatus as set forth in claim 1 wherein each of said cross beams is spaced a substantially same distance from an adjacent one of said cross beams.

18. The storage apparatus as set forth in claim 1 further comprising a fifth support beam extending transverse to said longitudinal axis and being adjustable between said first and second widths with said fifth support beam disposed between said third and fourth support beams.

19. The storage apparatus as set forth in claim 18 further comprising a plurality of fasteners securing each of said third, fourth, and fifth support beams to said first and second support beams.

20. The storage apparatus as set forth in claim 1 wherein each of said support beams has first and second support beam pieces with said first support beam piece being slidable relative to said second support beam piece for adjusting said support beams.

21. A storage apparatus attachable to a surface, said storage apparatus comprising:

a polygonal support frame having:

a first support beam defining a longitudinal axis and being adjustable along said longitudinal axis between a first length and a second length with said first support beam having first and second support bean pieces with said first piece of said first support beam defining first and second sets of apertures and said second piece of said first support beam defining a third set of apertures;

a second support beam extending along said longitudinal axis and being adjustable along said longitudinal axis between said first and second lengths with said second support beam having first and second support beam pieces with said first piece of said second support beam defining first and second sets of apertures and said second piece of said second support beam defining a third set of apertures;

a third support beam extending transverse to said longitudinal axis; and a fourth support beam spaced from said third support beam and extending transverse to said longitudinal axis;

a plurality of cross beams each coupled to at least one of said support beams;

a plurality of suspension legs coupled to and extending away from at least two of said support beams for coupling to the surface; and a plurality of rack segments supported on at least a portion of said support beams and said cross beams with said rack segments being removable during said adjustment along said longitudinal axis; and wherein said first support beam has first and second predefined mounting locations along said first support beam with said first mounting location defining an extended position of said first support beam having said first length and said second mounting location defining an adjusted position of said first support beam having said second length, and wherein said second support beam has third and fourth predefined mounting locations along said second support beam with said third mounting location defining an extended position of said second support beam having said first length and said fourth mounting location defining an adjusted position of said second support beam having said second length, said first set of apertures defined in said first piece of each of said first and second support beams located at said first and third mounting locations, said second set of apertures defined in said first piece of each of said first and second support beams located at said second and fourth mounting locations, said third set of apertures aligning with said first set of apertures when said first and second support beams are in said extended position and said third set of apertures aligning with said second set of apertures when said first and second support beams are in said adjusted position, and fasteners disposed only through said first and third sets of apertures of each of said first and second support beams at said first and third mounting locations when said first and second support beams are in said extended position, and disposed only through said second and third sets of apertures of each of said first and second support beams at said second and fourth mounting locations when said first and second support beams are in said adjusted position.

22. The storage apparatus as set forth in claim 21 wherein each of said first and second support beams has outer and inner surfaces with said surfaces positioned substantially parallel to each other and defining apertures at said first and third mounting locations for receiving said fasteners when said first and second support beams are in said extended position and said surfaces defining apertures at said second and fourth mounting locations for receiving said fasteners when said first and second support beams are in said adjusted position.

23. The storage apparatus as set forth in claim 21 wherein each of said first and second support beam pieces has inner and outer surfaces and a third surface extending substantially perpendicularly to each of said inner and outer surfaces with said third surface of said first piece defining at least one aperture located at said first mounting location and at least one aperture located at said second mounting location, and said third surface of said second piece defining at least one aperture aligning with said aperture of said third surface of said first piece at the first mounting location when said support beams are in said extended position and aligning with said aperture of said third surface of said first piece at the second mounting location when said support beams are in said adjusted position.

24. The storage apparatus as set forth in claim 21 wherein each of said fasteners is a nut and bolt assembly.

25. A storage apparatus attachable to a surface, said storage apparatus comprising:

a polygonal support frame having:

a first support beam defining a longitudinal axis with said first support beam defining a plurality of slots at predetermined positions along said first support beam;

a second support beam extending along said longitudinal axis with said second support beam defining a plurality of slots at predetermined positions along said second support beam;

a third support beam extending transverse to said longitudinal axis; and a fourth support beam spaced from said third support beam and extending transverse to said longitudinal axis;

a rack supported on said support frame;

a plurality of suspension legs coupled to and extending away from at least two of said support beams for coupling to the surface; and a plurality of cross beams each having first and second cross beam ends with each cross beam having a first tab coupled to an associated first cross beam end and insertable into a respective one of said first slots to mount said cross beam to said first support beam and each cross beam further having a second tab coupled to an associated second cross beam end and insertable into a respective one of said second slots to mount said cross beam to said second support beam.

26. The storage apparatus as set forth in claim 25 wherein each of said cross beams has a cross beam configuration extending between said ends and both of said cross beam ends having an end configuration different from said cross beam configuration.

27. The storage apparatus as set forth in claim 25 wherein said first tab extends transverse from said first cross beam end and said second tab extends transverse from said second cross beam end.

28. The storage apparatus as set forth in claim 25 wherein said first tab extends at a right angle from a terminal end of said first cross beam end and said second tab extends at a right angle from a terminal end of said second cross beam end.

* * * * *